US011304571B2

(12) United States Patent
Takagi

(10) Patent No.: US 11,304,571 B2
(45) Date of Patent: Apr. 19, 2022

(54) FOAM DISCHARGE DEVICE

(71) Applicant: Kao Corporation, Tokyo (JP)

(72) Inventor: Yoshimasa Takagi, Sumida-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 16/092,833

(22) PCT Filed: Apr. 14, 2017

(86) PCT No.: PCT/JP2017/015231
§ 371 (c)(1),
(2) Date: Oct. 11, 2018

(87) PCT Pub. No.: WO2017/179684
PCT Pub. Date: Oct. 19, 2017

(65) Prior Publication Data

US 2019/0125137 A1 May 2, 2019

(30) Foreign Application Priority Data

Apr. 15, 2016 (JP) ..... JP2016-082407
Apr. 15, 2016 (JP) ..... JP2016-082408
(Continued)

(51) Int. Cl.
*A47K 5/14* (2006.01)
*B05B 7/00* (2006.01)
(Continued)

(52) U.S. Cl.
CPC ..... *A47K 5/14* (2013.01); *A45D 27/02* (2013.01); *A45D 27/06* (2013.01); *A45D 44/00* (2013.01);
(Continued)

(58) Field of Classification Search
CPC ... A45K 5/14; A45K 5/12; A45K 5/16; A45K 5/12075; A45K 5/1217; B85B 1/02;
(Continued)

(56) References Cited

U.S. PATENT DOCUMENTS 10,117,548 B2 * 11/2018 Babikian ..... B01F 5/0693
2011/0101031 A1 * 5/2011 Hagleitner ..... A47K 5/16 222/190
(Continued)

FOREIGN PATENT DOCUMENTS

CN 102639247 A 8/2012
CN 202848373 U 4/2013
(Continued)

OTHER PUBLICATIONS

Japanese Office Action dated Dec. 11, 2018 in Japanese Patent Application No. 2016-212206 (with unedited computer generated English translation), 9 pages.
(Continued)

*Primary Examiner* — Lien M Ngo
(74) *Attorney, Agent, or Firm* — Oblon, McClelland, Maier & Neustadt, L.L.P.

(57) ABSTRACT

A foam discharging device includes: a storage portion that stores a liquid agent; a foamer mechanism that changes the liquid agent into foam to generate a foam body; and a discharging portion that discharges the foam body. The discharging portion includes a foam passing chamber that allows the foam body to pass, and one or a plurality of ejection-port forming wall portions that extend downward below the foam passing chamber, are formed into a closed-loop shape in plan view, have the inner space communicating with the foam passing chamber, and have the lower edge having an ejection port formed thereon. At least part of the ejection-port forming wall portion has a bottom end portion
(Continued)

formed into a shape that has a thickness reduced toward the lower side. The ejection-port forming wall portion and a second portion. The height position of a lower edge of the first portion is higher than the height position of a lower edge of the second portion.

12 Claims, 19 Drawing Sheets

(30) Foreign Application Priority Data

Oct. 28, 2016 (JP) ..... JP2016-212205
Oct. 28, 2016 (JP) ..... JP2016-212206

(51) Int. Cl.

| | |
|---|---|
| ***B65D 47/06*** | (2006.01) |
| ***A45D 27/02*** | (2006.01) |
| ***A45D 44/00*** | (2006.01) |
| ***A47K 5/16*** | (2006.01) |
| ***A45D 27/06*** | (2006.01) |
| ***B05B 7/08*** | (2006.01) |
| ***B65D 83/00*** | (2006.01) |
| ***A47K 5/12*** | (2006.01) |
| ***B05B 7/04*** | (2006.01) |
| *B05B 11/00* | (2006.01) |
| *A47K 10/36* | (2006.01) |

(52) U.S. Cl.
CPC ..... *A47K 5/12* (2013.01); *A47K 5/16* (2013.01); *B05B 7/0037* (2013.01); *B05B 7/0458* (2013.01); *B05B 7/0892* (2013.01); *B65D 47/06* (2013.01); *B65D 83/00* (2013.01); *A47K 5/1205* (2013.01); *A47K 5/1217* (2013.01); *A47K 2010/3668* (2013.01); *B05B 11/3087* (2013.01)

(58) Field of Classification Search
CPC ..... B85B 1/14; B05B 7/04; B05B 7/0458; B05B 7/0037
USPC ..... 222/190, 575, 565
See application file for complete search history.

(56) References Cited

U.S. PATENT DOCUMENTS

| | | | | |
|---|---|---|---|---|
| 2018/0141064 | A1 | 5/2018 | Takagi | |
| 2018/0153353 | A1 | 6/2018 | Takagi | |
| 2019/0047777 | A1* | 2/2019 | Takahashi | B05B 1/14 |

FOREIGN PATENT DOCUMENTS

| | | | |
|---|---|---|---|
| CN | 103920609 | A | 7/2014 |
| CN | 104955737 | A | 9/2015 |
| EP | 3 409 618 | A1 | 12/2018 |
| JP | 2006-325981 | A | 12/2006 |
| JP | 2006-346611 | A | 12/2006 |
| JP | 2010-149060 | A | 7/2010 |
| JP | 2010-269233 | A | 12/2010 |
| JP | 2011-31889 | A | 2/2011 |
| JP | 2013-121377 | A | 6/2013 |
| JP | 2015-160667 | A | 9/2015 |
| JP | 2016-209867 | A | 12/2016 |
| JP | 2017-12972 | A | 1/2017 |
| JP | 2017-193374 | A | 10/2017 |

OTHER PUBLICATIONS

International Search Report dated Jun. 27, 2017 in PCT/JP2017/015231 filed Apr. 14, 2017.
Combined Office Action and Search Report dated May 22, 2019 in Chinese Patent Application No. 201780023345.0 (with unedited computer generated English translation), 16 pages.
Office Action dated Apr. 2, 2019 in corresponding Japanese Patent Application No. 2017-080806 (with English Translation), 11 pages.
Supplemental Partial European Search Report dated Nov. 6, 2019 in European Patent Application No. 17782497.6.

* cited by examiner

FOAM DISCHARGE DEVICE

TECHNICAL FIELD

The present invention relates to foam discharging devices.

BACKGROUND ART

There is proposed a foam discharging device, which mixes air with various types of liquid material (liquid agent) such as hand soap, facial cleanser, dishwashing liquid, and a hairstyle product to make it in a foam shape, and discharge it.

For example, the foam discharging device described in Patent Document 1 has a plurality of ejection ports, each of which is disposed and has the diameter set so as to form a shaped object of foam that depicts a character with one pressing operation to the nozzle head.

RELATED ART DOCUMENT

Patent Document 1: Japanese Patent Application Laid-open No. 2010-149060

SUMMARY OF THE INVENTION

The present invention relates to a foam discharging device, including:

a storage portion that stores a liquid agent;

a foamer mechanism that changes the liquid agent into foam to generate a foam body; and a discharging portion that discharges the foam body, in which the discharging portion includes:

a foam passing chamber that allows the foam body to pass; and one or a plurality of ejection-port forming wall portions that: extend downward below the foam passing chamber; have a planer shape formed into a closed-loop shape; have an inner space communicating with the foam passing chamber; and have a lower end having an ejection port formed thereon, and (1) a bottom end portion of at least part of the ejection-port forming wall portion is formed into a shape that has a thickness reduced toward the lower side; the ejection-port forming wall portion includes a first portion and a second portion; and the height position of a lower edge of the first portion is higher than the height position of a lower edge of the second portion, or (2) the ejection-port forming wall portion includes a first wall portion and a second wall portion; and an adhesive property of the foam body relative to the lower edge of the first wall portion is stronger than the adhesive property of the foam body relative to the lower edge of the second wall portion.

BRIEF DESCRIPTION OF THE DRAWINGS

FIG. 3(*a*) is a bottom view; FIG. 3(*b*) is a side view as viewed in the direction of the arrow B in FIG. 3(*a*); and (c) is a perspective view as viewed from the lower surface side.

FIG. 4(*a*) is a bottom view; FIG. 4(*b*) is a side view as viewed in the direction of the arrow B in FIG. 4(*a*); and FIG. 4(*c*) is a perspective view as viewed from the lower surface side.

FIG. 5(*a*) is a bottom view; FIG. 5(*b*) is a side view as viewed in the direction of the arrow B in FIG. 5(*a*); and FIG. 5(*c*) is a perspective view as viewed from the lower surface side.

FIG. 7(*a*) is a bottom view; FIG. 7(*b*) is a side view as viewed in the direction of the arrow B in FIG. 7(*a*); and FIG. 7(*c*) is a perspective view as viewed from the lower surface side.

FIG. 8(*a*) is a bottom view concerning the modification examples 2 and 3; FIG. 8(*b*) is a side view concerning the modification example 2 as viewed in the direction of the arrow B in FIG. 8(*a*); and FIG. 8(*c*) is a side view concerning the modification example 3 as viewed in the direction of the arrow B.

FIG. 9(*a*) is a bottom view; FIG. 9(*b*) is a side view as viewed in the direction of the arrow B in FIG. 9(*a*); and FIG. 9(*c*) is a perspective view as viewed from the lower surface side.

FIG. 10(*a*) is a bottom view; FIG. 10(*b*) is a side view as viewed in the direction of the arrow B in FIG. 10(*a*); and FIG. 10(*c*) is a perspective view as viewed from the lower surface side.

FIG. 11(*a*) is a bottom view: FIG. 11(*b*) is a side view as viewed in the direction of the arrow B in FIG. 11(*a*); and FIG. 11(*c*) is a perspective view as viewed from the lower surface side.

FIG. 12(*a*) is a bottom view; FIG. 12(*b*) is a side view as viewed in the direction of the arrow B in FIG. 12(*a*); and FIG. 12(*c*) is a perspective view as viewed from the lower surface side.

FIG. 13(*a*) is a bottom view; FIG. 13(*b*)

is a side view as viewed in the direction of the arrow B in FIG. 13(*a*); and FIG. 13(*c*) is a perspective view as viewed from the lower surface side.

FIG. 14(*a*) is a diagram concerning a modification example 1; FIG. 14(*b*) is a diagram concerning a modification example 2; and FIG. 14(*c*) is a diagram concerning a modification example 3.

DETAILED DESCRIPTION OF THE INVENTION

Figure 1:
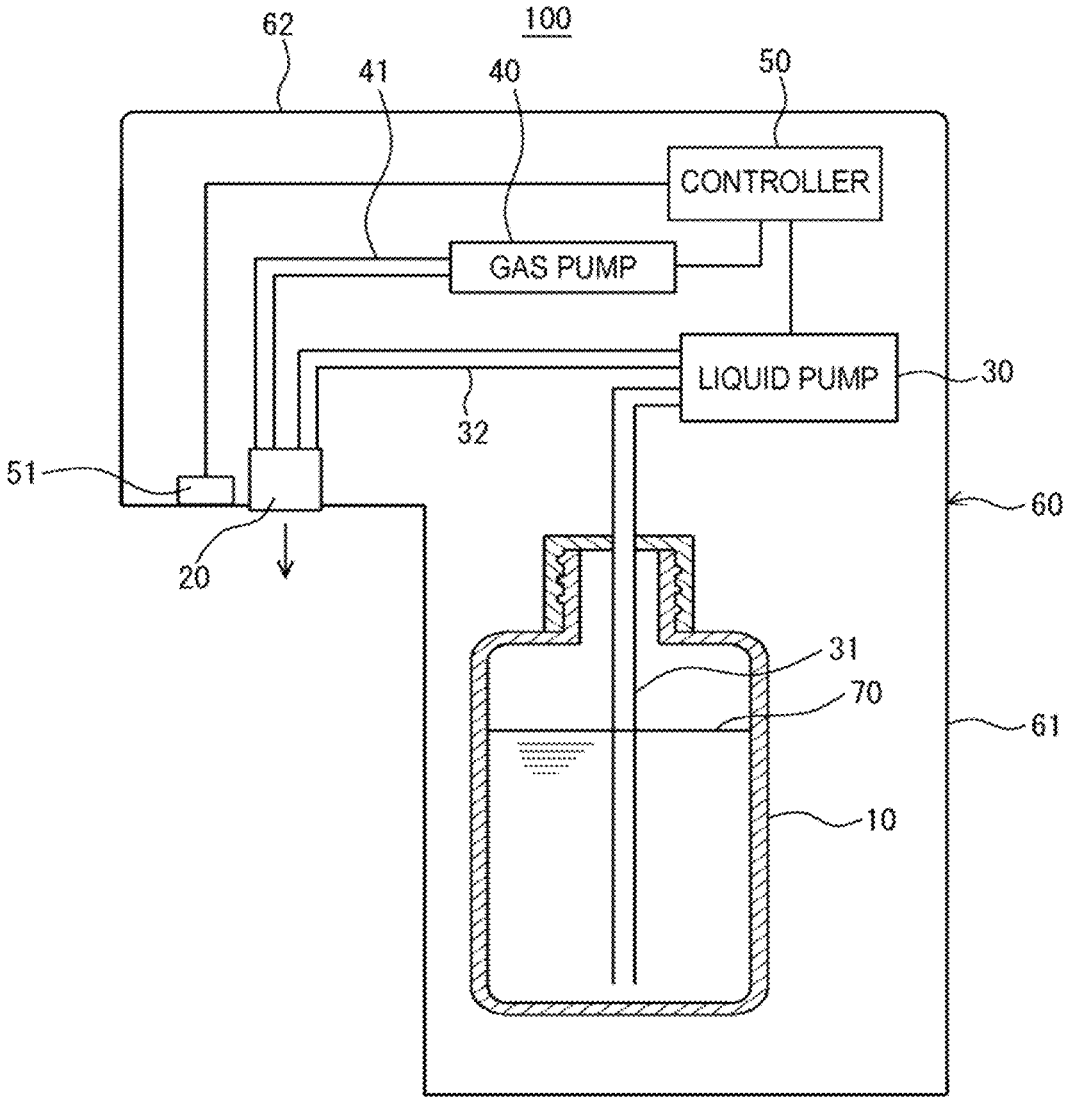
FIG. 1 is an explanatory view illustrating the configuration of a foam discharging device according to the first exemplary embodiment.

The technique described in Patent Document 1 can only form a shaped object of foam having a simple shape.

The present invention relates to a foam discharging device capable of forming shaped objects of foam having a desired three-dimensional shape with a more elaborate design.

Hereinbelow, preferred exemplary embodiments according to the present invention will be described with reference to the drawings. Note that, in all the drawings, the same reference characters are attached to similar constituent components, and detailed explanation thereof will not be repeated.

As illustrated in FIG. 1, the foam discharging device 100 according to the exemplary embodiment provides an electrically driven foam discharging device, and includes: a storage portion 10 that stores a liquid agent 70; a foamer mechanism 21 (FIG. 2) that changes the liquid agent 70 into foam to generate a foam body; and a discharging portion 20 that discharges the foam body. The discharging portion 20 includes: a foam passing chamber 209 (FIG. 2) that allows the foam body to pass; and one or a plurality of ejection-port forming wall portions 82 (FIG. 2) that: extend downward below the foam passing chamber 209; have the planer shape formed into a closed-loop shape; have an inner space communicating with the foam passing chamber 209; and have the lower end having an ejection port 83 formed thereon. (1) A bottom end portion of at least part of the ejection-port forming wall portion 82 is formed into a shape that has a thickness reduced toward the lower side; the ejection-port forming wall portion 82 includes a first portion and a second portion; and the height position of a lower edge of the first portion is higher than the height position of a lower edge of the second portion, or (2) the ejection-port forming wall portion 82 includes a first wall portion and a second wall portion; and an adhesive property of the foam body relative to a lower edge of the first wall portion is stronger than the adhesive property of the foam body relative to a lower edge of the second wall portion.

Furthermore, a foam discharging unit 80 according to this exemplary embodiment provides a foam discharging unit 80 that is attached to a foam discharging device including the storage portion 10 that stores the liquid agent 70 and the foamer mechanism 21 that changes the liquid agent 70 into foam to generate a foam body, the foam discharging unit 80 discharging the foam body (here, the foam discharging device represents a thing obtained by excluding the foam discharging unit 80 from the foam discharging device 100). The foam discharging unit 80 includes a plate-like portion 81, and also includes one or a plurality of ejection-port forming wall portions 82 that: protrude from a one-side surface (lower surface 81*a*) of the plate-like portion 81 in a direction perpendicular to a plate surface of the plate-like portion 81; are formed into a closed-loop shape when viewed from the protruding direction; have an inner space communicating with a space of the plate-like portion 81 on a side of an other-side surface (upper surface 81*b*) of the plate-like portion 81; and have a tip end having an ejection port 83 formed thereon. (1) A tip end portion of at least part of the ejection-port forming wall portion 82 is formed into a shape that has a thickness reduced toward the tip end; the ejection-port forming wall portion 82 includes a first portion and a second portion; and the distance at the first portion from the plate-like portion 81 to the tip end edge thereof is shorter than the distance at the second portion from the plate-like portion 81 to the tip end edge thereof, or (2) the ejection-port forming wall portion 82 includes a first wall portion and a second wall portion, and an adhesive property of the foam body relative to the tip end edge of the first wall portion is stronger than the adhesive property of the foam body relative to the tip end edge of the second wall portion.

First Exemplary Embodiment

First, the first exemplary embodiment will be described with reference to FIGS. 1 to 3(*c*), and FIGS. 16(*a*) and 16(*b*).

As illustrated in FIG. 1, a foam discharging device 100 according to this exemplary embodiment includes the storage portion 10 that stores the liquid agent 70, the foamer mechanism 21 (FIG. 2) that changes the liquid agent 70 into foam to generate a foam body, and the discharging portion 20 that discharges the foam body.

Figure 2:
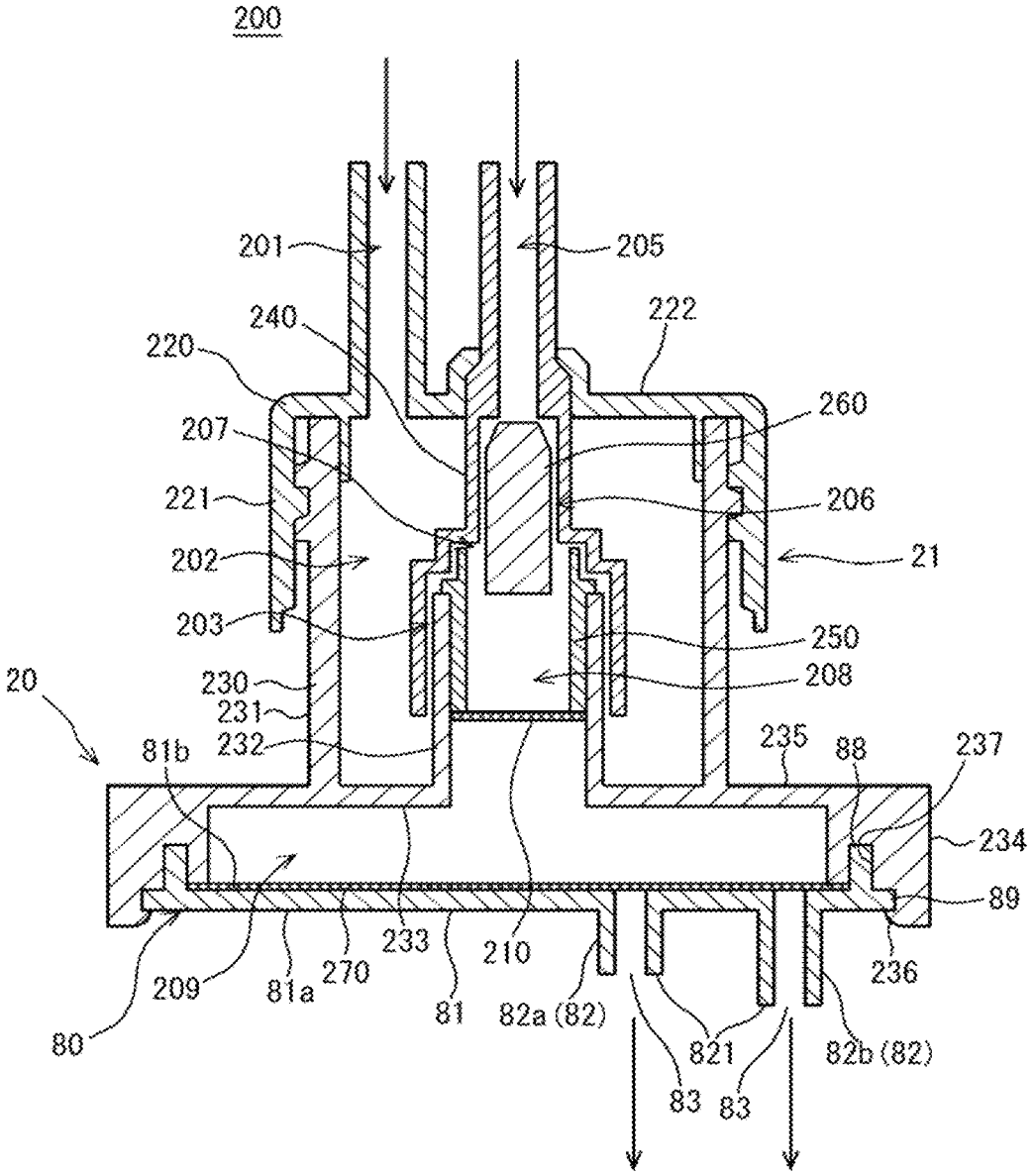
FIG. 2 is a sectional view schematically illustrating an example of the configuration of a foamer mechanism and a discharging portion of the foam discharging device according to the first exemplary embodiment.

As illustrated in FIG. 2, the discharging portion 20 includes the foam passing chamber 209 that allows the foam body to pass, and the one or a plurality of ejection-port forming wall portions 82 that: extend downward below the foam passing chamber 209; are formed into a closed-loop shape in plan view; have the inner space communicating with the foam passing chamber 209; and have the lower end having the ejection port 83 formed thereon.

Figure 3A:
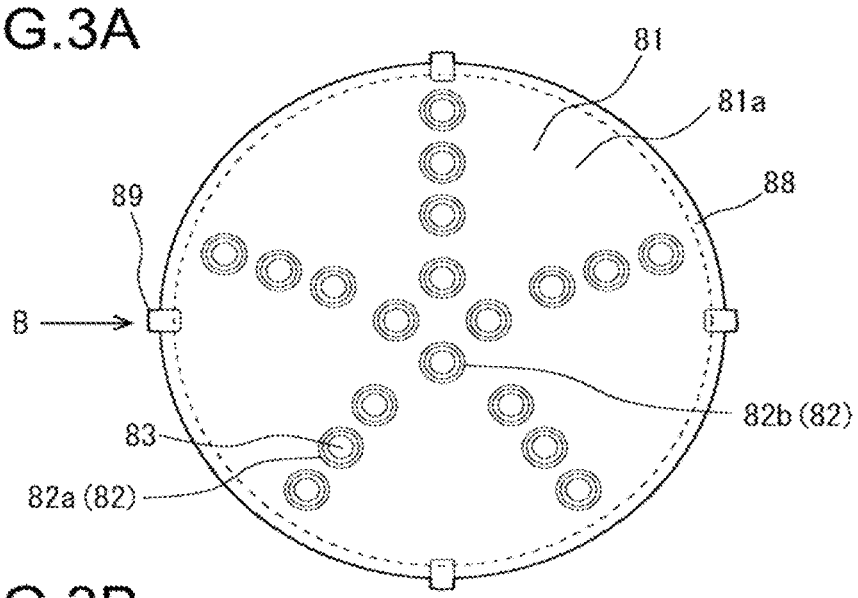
FIGS. 3(*a*), 3(*b*), and 3(*c*) are diagrams each illustrating a foam discharging unit of the foam discharging device according to the first exemplary embodiment.
Figure 3B:
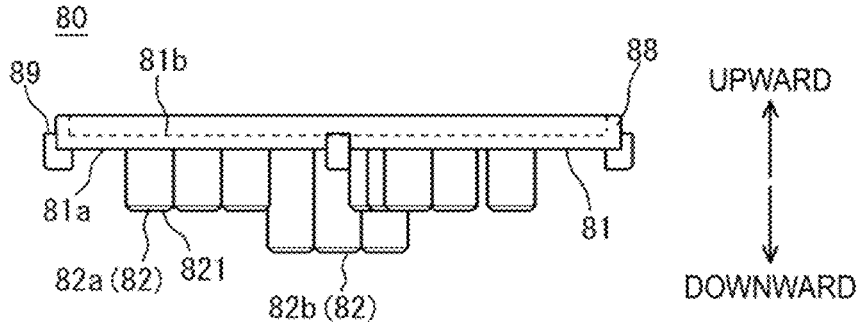
Figure 3C:
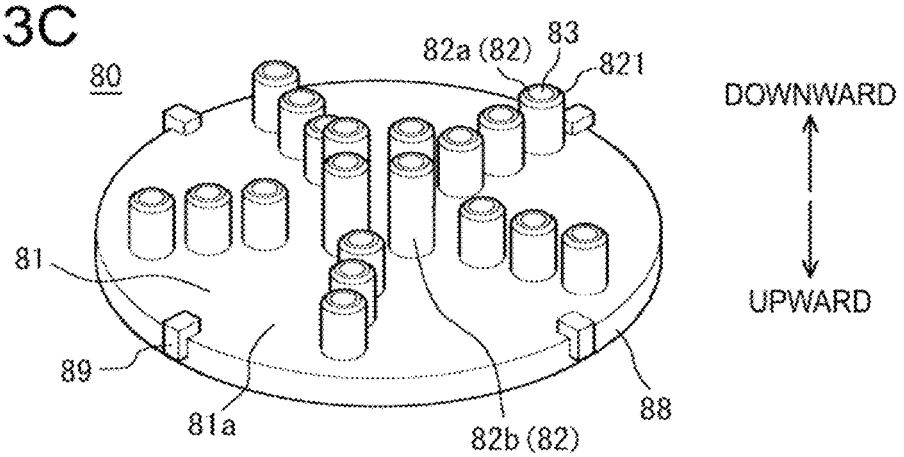

As illustrated in FIGS. 3(*b*) and 3(*c*), a bottom end portion of at least part of each of the ejection-port forming wall portions 82 is formed into a shape that has a thickness reduced toward the lower side.

The ejection-port forming wall portion 82 includes a first portion (for example, an ejection-port forming wall portion 82*a*) and a second portion (for example, an ejection-port forming wall portion 82*b*). The height position of a lower edge of the first portion is higher than the height position of a lower edge of the second portion. The height position as used herein means a height position relative to the common reference point. That is, the height position of the lower edge of the first portion is higher than the height position of the lower edge of the second portion means that the first height difference is greater than the second height difference, where the first height difference represents a height difference in the vertical direction between the reference point and the lower edge of the first portion, and the second height difference represents a height difference in the vertical direction between the reference point and the lower edge of the second portion. It may be possible to set the reference point, for example, to be one point on a discharging destination to which the foam body is discharged.

According to this exemplary embodiment, it is possible to form a shaped object of foam having a desired three-dimensional shape with a more elaborate design.

Here, the "ejection-port forming wall portion 82 extending downward below the foam passing chamber 209" means, for example, that the wall surface (inner surface) of the ejection-port forming wall portion 82 is configured as a vertical surface or substantially a vertical surface (for example, a plane inclined at an angle equal to or less than 5 degrees relative to the vertical direction).

However, the present invention is not limited to this example, and it may be possible that the "ejection-port forming wall portion 82 extending downward below the foam passing chamber 209" means that the axis center of the ejection-port forming wall portion 82 extends vertically or substantially vertically (for example, the direction of the axis center extends at an angle equal to or less than 5 degrees relative to the vertical direction). The axis center of the ejection-port forming wall portion 82 is an imaginary line connecting the center of gravity of the inner space of the ejection-port forming wall portion 82 in plane cross section at the top end position (base end position) thereof, with the center of gravity of this inner space in plane cross section at the lower end position (tip end position) thereof. For example, even if the ejection-port forming wall portion 82 has a frustum shape or other shape having the inclined wall surface, this shape is included as long as the axis center extends vertically or substantially vertically.

Furthermore, in this specification, the ejection-port forming wall portion represents each ejection-port forming wall portion 82 having a planar shape with a closed-loop shape, and in some cases, also represents a collective body of a plurality of ejection-port forming wall portions 82 (a group of ejection-port forming wall portions).

Furthermore, the bottom end portion of the ejection-port forming wall portion 82 is a portion of the ejection-port forming wall portion 82 located in the vicinity of the lower end (in the vicinity of the lower edge) thereof.

In addition, the lower edge of the first portion is an edge of the first portion located at the lowest portion thereof. The height position of the lower edge of the first portion may be set to be the average of the height positions of the lower edges of respective portions of the first portions.

Similarly, the lower edge of the second portion is an edge of the second portion located at the lowest portion thereof. The height position of the lower edge of the second portion may be set to be the average of the height positions of the lower edges of respective portions of the second portion.

The liquid agent 70 that is changed into foam may include hand soap as a representative example, but is not limited to this. Examples thereof may include various things that are used in a foam shape such as facial cleanser, makeup remover, dishwashing liquid, hairstyle product, body soap, shaving cream, cosmetic agent for skin such as foundation and skin care agent, hair dye, disinfectant, and cream to be spread on bread.

It is preferable to use a liquid agent 70 having the viscosity equal to or more than 1 mPa·s and equal to or less than 15 mPa·s.

As illustrated in FIG. 1, the foam discharging device 100 includes, for example, a body 60, and various constituent elements provided in the body 60. These constituent elements include, for example, the storage portion 10, the discharging portion 20, a liquid pump (liquid-agent supplying actuator) 30, a gas pump (gas supplying actuator) 40, a controller 50, and a detecting portion 51. These constituent elements are, for example, accommodated in the body 60. In addition, for example, the discharging portion 20 is integrated with the foamer mechanism 21 (see FIG. 2).

In the description of the configuration of the foam discharging device 100, the top-bottom direction indicates the direction at the time when the foam discharging device 100 is installed, and the ejection-port forming wall portion 82 extends downward below the foam passing chamber 209 in the state where the foam discharging device 100 has been installed. The direction of discharge of the foam body from the discharging portion 20 is the same as the direction in which the ejection-port forming wall portion 82 protrudes from the foam passing chamber 209, and the direction of discharge of the foam body from the discharging portion 20 is downward in FIGS. 1 and 2. In addition, in other exemplary embodiments and modification examples described below, the direction of discharge of the foam body from the discharging portion 20 is also the same as the direction in which the ejection-port forming wall portion 82 protrudes from the foam passing chamber 209, and is downward.

In FIG. 1, the body 60 is schematically illustrated as a side-surface shape, and schematic arrangement (arrangement in the body 60) when the foam discharging device 100 is viewed from the side surface is illustrated for the discharging portion 20 and the detecting portion 51.

In addition, in FIG. 1, block configuration is shown for the liquid pump 30, the gas pump 40, and the controller 50.

The body 60 includes, for example, a main body portion 61, and a head portion 62 supported by the main body portion 61. The head portion 62 is formed integrally with the upper portion of the main body portion 61 so as to protrude horizontally from the upper portion of the main body portion 61 in a hang-over state. The direction in which the head portion 62 protrudes from the main body portion 61 is set to be forward.

The main body portion 61, for example, accommodates the storage portion 10. The head portion 62 is provided with the discharging portion 20. The detecting portion 51 may be disposed in either the main body portion 61 or the head portion 62. In addition, the liquid pump 30, the gas pump 40, and the controller 50 may be disposed in either the main body portion 61 or the head portion 62.

The discharging portion 20 is configured, for example, so as to discharge a foam body from the lower surface of the head portion 62. That is, the foam discharging device 100 is disposed such that the surface of the head portion 62 from which the foam body is discharged faces downward.

Part or whole of the discharging portion 20 may project downward from the lower surface of the head portion 62.

Similarly, part of the detecting portion 51 may project downward from the lower surface of the head portion 62. In addition, the detecting portion 51 may be provided on the main body portion 61 side, rather than on the head portion 62.

The main body portion 61 may be configured such that, for example, the back surface (the surface on the right side in FIG. 1) thereof or the side surface (the surface on the side going behind the paper plane or coming out of the paper plane in FIG. 1) or other surface can be fixed on the surface of a wall, or may be configured so as to be able to be placed on a base such as a washbasin countertop.

For example, the storage portion 10 may be a bottle container including a bottle body that stores the liquid agent 70 and has a bottomed hollow-cylindrical shape with a neck portion, and a cap that is detachably mounted on the neck portion of the bottle body. The storage portion 10 is filled with the liquid agent 70. That is, the foam discharging device 100 includes the liquid agent 70 with which the storage portion 10 is filled.

The body 60 is configured, for example, such that the storage portion 10 is detachable with respect to the body 60. The method for refilling the foam discharging device 100 with the liquid agent 70 includes, for example, a method of replacing the storage portion 10 with a new one, and a method of refilling the bottle body with the liquid agent 70 in a state where the cap is detached from the neck portion of the bottle body.

The foam discharging device 100 further includes: a suction pipe 31 that is inserted into the storage portion 10 and is connected with the liquid pump 30; a liquid supplying pipe 32 that connects the liquid pump 30 with the foamer mechanism 21 (FIG. 2); and an air supplying pipe 41 that connects the gas pump 40 with the foamer mechanism 21.

The liquid pump 30 sucks the liquid agent 70 within the storage portion 10 through the suction pipe 31, and delivers the liquid agent 70 through the liquid supplying pipe 32 to the foamer mechanism 21. On the other hand, the gas pump 40 sucks an atmosphere (in other words, the air) around the gas pump 40, and delivers the air through the air supplying pipe 41 to the foamer mechanism 21.

In the foamer mechanism 21, the liquid agent 70 delivered from the liquid pump 30 is mixed with the air delivered from the gas pump 40 to change the liquid agent 70 into foam. Then, the liquid agent 70 that has been changed into foam is discharged from the discharging portion 20.

The detecting portion 51 is a sensor that detects a discharging destination serving as an object to which the foam body is discharged. Various detecting manners may be used for the detecting portion 51, and it may be possible to use, for example, a transparent type sensor such as a photoelectric sensor, a reflective type sensor, a capacitive sensor, a contact sensor, and an ultrasonic sensor.

Examples of the discharging destination include, for example, a hand of a user, a sponge, various types of painting items such as a brush, a dish, a food, and a beverage poured into a dish. Below, description will be made as the discharging destination being a hand.

In the case of this exemplary embodiment, the detecting portion 51 detects a discharging destination, and this detection causes a discharge trigger that serves as a trigger for discharging the liquid agent that has been changed into foam. In the case where the discharge trigger occurs, the liquid pump 30 and the gas pump 40 operate so that the foam body is discharged from the discharging portion 20 by a predetermined amount, and then, the liquid pump 30 and the gas pump 40 stop operating.

The liquid pump 30 and the gas pump 40 operate under the control of the controller 50, and supply the discharging portion 20 with the liquid agent 70 and the air, respectively. The liquid pump 30 and the gas pump 40 are each driven by an electrically driven motor, and the electrically driven motor is electrically connected with the controller 50.

The controller 50 includes: a read only memory (ROM) that stores and holds control programs for the liquid pump 30 and the gas pump 40; a central processing unit (CPU) that controls and operates in accordance with the control program; and a random access memory (RAM) that functions, for example, as a working area for the CPU.

The power for the controller 50, the detecting portion 51, the liquid pump 30, and the gas pump 40 in the foam discharging device 100 may be supplied through the commercial power supply or through a battery.

Next, one example of the configuration of the foamer mechanism 21 and the discharging portion 20 will be described with reference to FIG. 2. Here, while each configuration of the discharging portion 20 may be described on the basis of the positional relationship illustrated in FIG. 2 for the purpose of convenience, this positional relationship of each configuration in the description does not necessarily match the positional relationship of each configuration of the foamer mechanism 21 and the discharging portion 20 when the foam discharging device 100 is in use.

As illustrated in FIG. 2, the foamer mechanism 21 includes a gas inlet 201 that allows gas (air) to be introduced through the air supplying pipe 41, and a liquid-agent inlet 205 that allows the liquid agent 70 to be introduced through the liquid supplying pipe 32.

The air introduced through the gas inlet 201 into the foamer mechanism 21 passes through a gas front chamber 202 and a narrow gas passage 203 in this order, and is supplied to the mixing portion 207 of the mixing chamber 208.

On the other hand, the liquid agent 70 introduced through the liquid-agent inlet 205 to the discharging portion 20 passes through a narrow liquid-agent passage 206, and is supplied to the mixing portion 207 of the mixing chamber 208.

In the mixing portion 207, the liquid agent 70 is mixed with the air, whereby the liquid agent 70 is changed into a coarse foam body.

A mesh 210 is provided at a latter stage of the mixing chamber 208. The coarse foam body passes through the mesh 210 to be changed into fine, uniform foam body, and is introduced into the foam passing chamber 209 of the discharging portion 20.

As described above, in the case of the this exemplary embodiment, the foam discharging device 100 further includes: a liquid-agent supplying actuator (liquid pump 30) that supplies the liquid agent 70 from the storage portion 10 to the foamer mechanism 21; a gas supplying actuator (gas pump 40) that supplies gas to the foamer mechanism 21; and a controller 50 that operates and controls the gas supplying actuator and the liquid-agent supplying actuator. The liquid agent 70 and the gas are supplied to the foamer mechanism 21 under the control of the controller 50 to generate the foam body.

The foamer mechanism 21 and the discharging portion 20 are provided integrally with each other to form a discharging unit 200.

The discharging unit 200 includes, for example: a cap member 220 that has a hollow cylindrical portion 221 having a tubular shape and having an upper end portion closed by a closing portion 222; a hollow cylindrical member 230; a flow-path forming outside sleeve 240; a flow-path forming inside sleeve 250; and a flow-path forming core body 260.

The closing portion 222 of the cap member 220 has a tubular portion formed so as to protrude upward and have the gas inlet 201 inside thereof, and an insertion hole into which a tubular portion having the liquid-agent inlet 205 is inserted.

The hollow cylindrical member 230 includes: an upper portion having a double-tube structure having an external hollow-cylindrical portion 231 having a tubular shape and an internal hollow cylindrical portion 232 having a tubular shape with a diameter smaller than that of the external hollow-cylindrical portion 231; a holding portion 234 having a tubular shape formed so as to have a diameter larger than that of the external hollow-cylindrical portion 231; and a top surface portion 235 that closes the upper end of the holding portion 234.

The space of the inside of the holding portion 234 forms the foam passing chamber 209. The foam passing chamber 209 communicates with an area where the mesh 210 is disposed, through an opening formed at the center of the top surface portion 235.

The external hollow-cylindrical portion 231 of the hollow cylindrical member 230 and the hollow cylindrical portion 221 of the cap member 220 are fixed with each other by a fixing method such as screwing.

The flow-path forming outside sleeve 240 is formed so as to include a multiple-stage hollow cylindrical portion shaped such that the inner diameter and the outer diameter vary in a multiple-stage manner in the axial direction (in the top-bottom direction) of the flow-path forming outside sleeve 240. That is, the flow-path forming outside sleeve 240 has the inner diameter and the outer diameter, each of which varies in a stepwise manner so that the inner diameter and the outer diameter increase toward the bottom portion. For example, the flow-path forming outside sleeve 240 has four stages of hollow cylindrical portions, and the hollow cylindrical portion located at the uppermost stage (in other words, one having the smallest diameter) of them has the liquid-agent inlet 205 formed inside thereof. In addition, within the hollow cylindrical portion at the lowermost stage of the flow-path forming outside sleeve 240, the upper portion of the internal hollow cylindrical portion 232 is disposed adjacently to the inner peripheral surface of this hollow cylindrical portion.

The flow-path forming inside sleeve 250 is formed so as to have a tubular shape, and is fitted with the internal hollow cylindrical portion 232 so that the outer peripheral surface of the flow-path forming inside sleeve 250 is in close contact with the inner peripheral surface of the internal hollow cylindrical portion 232. However, the upper portion of the flow-path forming inside sleeve 250 sticks out upward further than the internal hollow cylindrical portion 232. The upper portion of the flow-path forming inside sleeve 250 is disposed so as to extend from the inside of the hollow cylindrical portion located at the lowermost stage of the flow-path forming outside sleeve 240 to the vicinity of the upper end of the hollow cylindrical portion located at the second stage from the bottom.

The flow-path forming core body 260 is formed into a cylindrical column shape, and is disposed so as to be coaxial with the flow-path forming outside sleeve 240. More specifically, for example, the flow-path forming core body 260 is disposed so as to extend from the inside of the hollow cylindrical portion located at the second stage from the top of the flow-path forming outside sleeve 240 to the inside of the upper end portion of the hollow cylindrical portion located at the lowermost stage of the flow-path forming outside sleeve 240. The lower portion of the flow-path forming core body 260 is disposed at the inside of the upper portion of the flow-path forming inside sleeve 250. The flow-path forming core body 260 is, for example, held by the flow-path forming outside sleeve 240.

The gas passage 203 is formed by a space between the inner peripheral surface of the hollow cylindrical portion located at the lowermost stage as well as the hollow cylindrical portion located at the second stage from the bottom of the flow-path forming outside sleeve 240 and the outer peripheral surface of the upper portion of the internal hollow cylindrical portion 232 as well as the outer peripheral surface of the upper portion of the flow-path forming inside sleeve 250.

In addition, the liquid-agent passage 206 is formed by a space between the inner peripheral surface of the hollow cylindrical portion located at the second stage from the top of the flow-path forming outside sleeve 240 and the outer peripheral surface of the upper portion of the flow-path forming core body 260. The liquid-agent passage 206 is, for example, separated into a plurality of lines.

In addition, the mixing chamber 208 is formed by the inner space of the flow-path forming inside sleeve 250. The opening of the lower end of the flow-path forming inside sleeve 250 is closed by the mesh 210. The mixing portion 207 serves as the upper end portion of the mixing chamber 208, and at this mixing portion 207, the downstream end of the liquid-agent passage 206 merges with the downstream end of the gas passage 203.

In addition, the gas front chamber 202 is a facing space between the closing portion 222 and the closing portion 233, and is formed by a space between the inner peripheral surface of the external hollow-cylindrical portion 231 and the outer peripheral surface of a portion of the flow-path forming outside sleeve 240 that protrudes downward beyond the closing portion 222 as well as the outer peripheral surface of the lower portion of the internal hollow cylindrical portion 232. The gas front chamber 202 is, for example, formed into an annular shape in plane cross section.

The foamer mechanism 21 includes, from among the configurations described above, at least the gas passage 203, the liquid-agent passage 206, the mixing chamber 208 (the mixing chamber 208 includes the mixing portion 207), and the mesh 210.

The discharging portion 20 further includes a foam discharging unit 80 that is held by the holding portion 234 so as to close the opening of the holding portion 234 on the lower surface side thereof.

The foam discharging unit 80 includes: a plate-like portion 81 that defines the lower end of the foam passing chamber 209; and one or a plurality of ejection-port forming wall portions 82 that extend downward from the lower surface 81*a* of the plate-like portion 81. As described above, the foam passing chamber 209 includes the bottom portion formed by the plate-like portion 81, and the bottom portion has the ejection-port forming wall portions 82 formed thereon (the ejection-port forming wall portions 82 extend downward from the bottom portion).

The foam discharging unit 80 is held by the holding portion 234 in a posture in which the plate-like portion 81 is horizontal. The holding portion 234 detachably holds the foam discharging unit 80.

More specifically, the plate-like portion 81 is formed into a circular shape in plan view, and the foam discharging unit 80 further includes: an annular protrusion 88 that is a protrusion having an annular shape in plane and erecting upward from the peripheral edge portion of the plate-like portion 81; and a plurality of locking protrusions 89 that protrude outward in the radial direction of the plate-like portion 81 from the peripheral edge portion of the plate-like portion 81.

On the other hand, on the lower surface side of the holding portion 234, there are provided: a slit-shaped insertion hole 237 that makes one turn in a circular shape in plan view and into which the annular protrusion 88 is inserted; and an annular locking portion 236 that engages with the locking protrusion 89 to hold the foam discharging unit 80. By pulling the foam discharging unit 80 downward, the lock of the locking portion 236 relative to the locking protrusion 89 is configured to be disengaged, whereby the foam discharging unit 80 can be detached from the holding portion 234. In addition, by pushing the foam discharging unit 80 upward in a state where the annular protrusion 88 is aligned with the insertion hole 237, the locking portion 236 is locked with respect to the locking protrusion 89, whereby the foam discharging unit 80 can be held by the holding portion 234.

In addition, a mesh 270 may be provided on the upper surface 81*b* of the plate-like portion 81 as illustrated in the drawing.

The foamer mechanism 21 and the discharging portion 20 are, for example, configured as described above. However, the structures of the discharging portion 20 and the foamer mechanism 21 are not limited to those described here, and it may be possible to employ other structures.

As described above, the mesh 210 (porous body) is disposed at the outlet of the mixing chamber 208 in which the air and the liquid agent 70 are mixed with each other. The foam body generated in the mixing chamber 208 passes through the mesh 210 and flows into the foam passing chamber 209. Then, the foam body passes through the foam passing chamber 209, passes through the inside of the ejection-port forming wall portion 82, and is discharged from the ejection port 83 at the lower end of the ejection-port forming wall portion 82.

Here, as described above, the foamer mechanism 21 includes the mixing chamber 208 in which the liquid agent 70 and the air are mixed with each other. In addition, the maximum value of a cross sectional area (in other words, the area of plane cross section), which is perpendicular to the direction of discharge of the foam body, of the foam passing chamber 209 is greater than the maximum value of a cross sectional area (area of plane cross section), which is perpendicular to the direction of discharge described above, of the mixing chamber 208, and also is greater than the total value of maximum values of cross sectional areas (areas of plane cross section), each of which is perpendicular to the direction of discharge described above, of inner spaces of respective ejection-port forming wall portions 82.

Thus, the maximum value of the cross sectional area of the foam passing chamber 209 is greater than the cross sectional area (area of plane cross section), which is perpendicular to the direction of discharge described above, of the outlet of the mixing chamber 208. In addition, the maximum value of the cross sectional area of the foam passing chamber 209 is greater than the cross sectional area described above of a portion (for example, the bottom end portion of the mixing chamber 208), which is adjacent to the foam passing chamber 209, of the mixing chamber 208. The total value of cross sectional areas, each of which is perpendicular to the direction of discharge described above, of inner spaces of portions (upper end portions of respective ejection-port forming wall portions 82), each of which is adjacent to the foam passing chamber 209, of respective ejection-port forming wall portions 82 is smaller than the maximum value of the cross sectional area (area of plane cross section) of the foam passing chamber 209. In addition, the total value of cross sectional areas, each of which is perpendicular to the direction of discharge described above, of inner spaces of portions (each of which is the upper end portion of each of the ejection-port forming wall portions 82 and is formed at the bottom portion of the foam passing chamber 209), each of which is adjacent to the foam passing chamber 209, of respective ejection-port forming wall portions 82 is smaller than the area of the bottom portion of the foam passing chamber 209 formed by the plate-like portion 81.

Thus, in the course in which the foam body passes through the mixing chamber 208, the foam passing chamber 209, and the inside of the ejection-port forming wall portion 82 in this order, and is discharged from the ejection port 83, the flow path area for the foam body increases at the position where the foam body flows out from the mixing chamber 208 into the foam passing chamber 209, and then, decreases at the position where the foam body flows out from the foam passing chamber 209 into the ejection-port forming wall portion 82.

With this configuration, it is possible to discharge the foam body from the ejection port 83 at the lower end of the ejection-port forming wall portions 82 while sufficiently filling the inside of each of the ejection-port forming wall portions 82 with the foam body. This makes it possible to discharge the foam body having a desired shape from each of the ejection ports 83 in a more reliable manner, and to make a shaped foam object 91 (FIGS. 16(*a*) and 16(*b*)), which is a collective body of foam bodies discharged from these ejection ports 83, formed into a desired three-dimensional shape.

The area of plane cross section of the foam passing chamber 209 may be set so as to be constant at any position of the foam passing chamber 209 in the direction of discharge of the foam body, or may be set so as to change according to positions in the direction of discharge of the foam body.

It is preferable that the cross sectional area (area of plane cross section), which is perpendicular to the direction of discharge described above, of a portion (the bottom end portion of the foam passing chamber 209), which is adjacent to the ejection-port forming wall portion 82, of the foam passing chamber 209 is greater than the total value of maximum values of cross sectional areas (areas of plane cross section), each of which is perpendicular to the direction of discharge described above, of inner spaces of respective ejection-port forming wall portions 82.

Here, the cross sectional area of the inner space of the ejection-port forming wall portions 82 means a cross sectional area of a closed area surrounded in a continuous, circuit manner by an ejection-port forming wall portion 82 in cross section perpendicular to the direction of discharge described above.

In addition, in this exemplary embodiment, the number of the ejection-port forming wall portions 82 is plural, and hence, the total value of cross sectional areas of inner spaces of respective ejection-port forming wall portions 82 means the total value of cross sectional areas of inner spaces of these plurality of ejection-port forming wall portions 82. However, the present invention is not limited to this example, and the number of ejection-port forming wall portions 82 may be one. In this case, the total value of cross sectional areas of inner spaces of respective ejection-port forming wall portions 82 means the cross sectional area of the inner space of one ejection-port forming wall portion 82.

Next, with reference to FIGS. 3(*a*), 3(*b*), and 3(*c*), the foam discharging unit 80 will be described in more detail.

As illustrated in any of FIGS. 3(*a*), 3(*b*), and 3(*c*), the foam discharging unit 80 includes the plate-like portion 81 having a circular plate shape, and the plurality of ejection-port forming wall portions 82 that protrude from the lower surface 81*a* of the plate-like portion 81.

In the case of this exemplary embodiment, the ejection-port forming wall portions 82 are each formed into a circular, tubular shape, and the axis center and the wall surface of each of the ejection-port forming wall portions 82 are perpendicular to the lower surface 81*a*. Each of the ejection-port forming wall portions 82 has a lower edge 821 having an ejection port 83 formed thereon. The height of the lower edge 821 of each of the ejection-port forming wall portions 82 is constant, and the ejection port 83 is disposed horizontally.

Thus, the lower edge 821 of the ejection-port forming wall portions 82 has a portion that extends horizontally. In the case of this exemplary embodiment, the entire lower edge 821 of the ejection-port forming wall portions 82 extends horizontally in a ring shape.

Here, the lower edge 821 of the ejection-port forming wall portion 82 having a portion that extends horizontally may mean, for example, that the lower edge 821 of the ejection-port forming wall portion 82 has a portion that horizontally and continuously extends so as to be longer than the thickness of this lower edge 821.

Here, in the case where the length of the ejection-port forming wall portion 82 that protrudes from the lower surface 81*a* of the plate-like portion 81 is relatively short, the height position of the lower edge 821 is relatively high. On the other hand, in the case where this length is relatively long, the height position of the lower edge 821 is relatively low.

The plurality of ejection-port forming wall portions 82 include the ejection-port forming wall portion 82*a* and the ejection-port forming wall portion 82*b*. As illustrated in FIG. 3(*b*), the height position of the lower edge 821 of the ejection-port forming wall portion 82*a* is higher than the height position of the lower edge 821 of the ejection-port forming wall portion 82*b*.

Thus, in the case of this exemplary embodiment, the ejection-port forming wall portion 82*a* serves as the first portion, and the ejection-port forming wall portion 82*b* serves as the second portion.

That is, the discharging portion 20 has the plurality of ejection-port forming wall portions 82, and the plurality of ejection-port forming wall portions 82 include a first-portion configuring wall portion (for example, the ejection-port forming wall portion 82*a*) that configures the first portion, and a second-portion configuring wall portion (for example, the ejection-port forming wall portion 82*b*) that configures the second portion.

More specifically, in the case of this exemplary embodiment, the ejection port 83 of the first-portion configuring wall portion (for example, the ejection-port forming wall portion 82*a*) and the ejection port 83 of the second-portion configuring wall portion (for example, the ejection-port forming wall portion 82*b*) are each disposed horizontally, and the height position of the ejection port 83 of the first-portion configuring wall portion (for example, the ejection-port forming wall portion 82*a*) is higher than the height position of the ejection port 83 of the second-portion configuring wall portion (for example, the ejection-port forming wall portion 82*b*).

Furthermore, the lower edge 821 of the ejection-port forming wall portion 82*a* and the lower edge 821 of the ejection-port forming wall portion 82*b* each have a portion that extends horizontally. In the case of this exemplary embodiment, the entire lower edge 821 of the ejection-port forming wall portion 82*a* extends horizontally in a ring shape, and the entire lower edge 821 of the ejection-port forming wall portion 82*b* extends horizontally in a ring shape.

As described above, the foam discharging unit 80 is a foam discharging unit 80 attached to a foam discharging device (here, a thing formed by excluding the foam discharging unit 80 from the foam discharging device 100 is called a foam discharging device) that includes the storage portion 10 that stores the liquid agent 70, and the foamer mechanism 21 that changes the liquid agent 70 into foam to generate the foam body, and the foam discharging unit 80 discharges the foam body. The foam discharging unit 80 includes the plate-like portion 81, and also includes one or the plurality of ejection-port forming wall portions 82 that: protrude from the one-side surface (lower surface 81*a*) of the plate-like portion 81 in a direction perpendicular to a plate surface of the plate-like portion 81; are formed into a closed-loop shape when viewed from the protruding direction; have the inner space communicating with a space of the plate-like portion 81 on a side of the other-side surface (upper surface 81*b*) of the plate-like portion 81; and have a tip end having the ejection port 83 formed thereon. In addition, the ejection-port forming wall portion 82 includes the first portion (for example, the ejection-port forming wall portion 82*a*) and the second portion (for example, the ejection-port forming wall portion 82*b*), and the distance from the plate-like portion 81 to the tip end edge (lower edge 821) at the first portion is shorter than the distance from the plate-like portion 81 to the tip end edge (lower edge 821) at the second portion. In addition, the tip end portion (bottom end portion) of at least part of the ejection-port forming wall portion 82 is formed into a shape that has a thickness reduced toward the tip end (downward).

More specifically, in the case of this exemplary embodiment, by discharging the foam body through the plurality of ejection-port forming wall portions 82 of the foam discharging unit 80, it is possible to form a shaped foam object 91 shaped like a flower as illustrated in FIGS. 16(*a*) and 16(*b*). FIG. 16(*a*) is a planar image obtained by imaging a shaped foam object 91 actually formed using the foam discharging unit 80 illustrated in FIG. 3, and FIG. 16(*b*) is a perspective image obtained by imaging the shaped foam object 91 from the direction of the arrow B in FIG. 16(*a*) (from the side surface direction). The flower that the shaped foam object 91 intends to be shaped like has a shape having five petals that extend radially from the center in five directions.

As illustrated in FIGS. 3(*a*) and 3(*c*), a plurality of (for example, four) ejection-port forming wall portions 82*b* are arranged in the central portion of the foam discharging unit 80, and a plurality of ejection-port forming wall portions 82*a* for forming five petals are arranged radially from the central portion in five lines. More specifically, the four ejection-port forming wall portions 82*b* in the central portion are each disposed at a position corresponding to each apex of a square. In addition, each of the five lines of the ejection-port forming wall portions 82*a* includes three ejection-port forming wall portions 82*a* that are each disposed at equal intervals. As described above, while each of the plurality of ejection-port forming wall portions 82 has a circular shape in plan view, a group of ejection-port forming wall portions, which is a collective body of the plurality of ejection-port forming wall portions 82, forms a non-circular shape as a whole.

By discharging a foam body through the foam discharging unit 80 described above, it is possible to form a shaped foam object 91 that integrally has petal portions 91*a* each shaped like a petal and a central portion 91*b* located at the middle of the five petal portions 91*a*, as illustrated in FIGS. 16(*a*) and 16(*b*).

That is, by placing a hand (palm) below the discharging portion 20 in a horizontal posture, the detecting portion 51 detects the hand, which causing a discharge trigger. Then, the liquid pump 30 and the gas pump 40 are each activated, generating a foam body with the liquid agent 70 and the air supplied to the foamer mechanism 21. This foam body passes through the foam passing chamber 209 and the mesh 270, and is discharged from each of the ejection-port forming wall portions 82. After this, once discharging of the foam body by a predetermined amount is completed, the liquid pump 30 and the gas pump 40 stop their operations.

As a result, a shaped foam object 91 is formed on the hand.

Here, in the case of this exemplary embodiment, since the height position of the lower edge 821 of the ejection-port forming wall portions 82*a* is set to be higher than the height position of the lower edge 821 of the ejection-port forming wall portions 82*b*, it is possible to form a shaped foam object 91 shaped such that the petal portions 91*a* are raised so as to be higher (formed so as to be thicker) than the central portion 91*b*. That is, the ejection-port forming wall portions 82*a*, which are located at higher position, discharges a foam body more than that discharged from the ejection-port forming wall portions 82*b*, and the height position at which a foam body is released from the lower edge 821 differs between the ejection-port forming wall portion 82*a* and the ejection-port forming wall portion 82*b*. Thereby, it is possible to form the petal portions 91*a* composed mainly by the foam body discharged from the ejection-port forming wall portions 82*a* so as to be thicker than the central portion 91*b* composed mainly by the foam body discharged from the ejection-port forming wall portions 82*b*.

Thus, it is possible to make a shaped foam object 91 shaped like a flower have a three-dimensional shape with a highly elaborate design.

From the viewpoint of the shaping property of the shaped foam object 91, it is preferable that the difference in height between the first portion and the second portion is equal to or more than 1 mm, and more preferably, equal to or more than 2 mm. In addition, it is preferable that this difference is equal to or less than 8 mm, and more preferably, equal to or less than 5 mm. Furthermore, it is preferable that it is equal to or more than 1 mm and equal to or less than 8 mm, and more preferably, it is equal to or more than 2 mm and equal to or less than 5 mm.

Furthermore, from a similar viewpoint, it is preferable that the length of the ejection-port forming wall portion from the plate-like portion 81 to the lower edge 821 is equal to or more than 2 mm, more preferably, equal to or more than 3 mm, still more preferably, equal to or more than 5 mm. In addition, it is preferable that this length is equal to or less than 30 mm, more preferably, equal to or less than 25 mm, still more preferably, equal to or less than 20 mm. Furthermore, it is preferable that it is equal to or more than 2 mm and equal to or less than 30 mm, more preferably, equal to or more than 3 mm and equal to or less than 25 mm, still more preferably, equal to or more than 5 mm and equal to or less than 20 mm.

In the first exemplary embodiment, while the height of the ejection-port forming wall portion 82 is formed into two stages: the first portion and the second portion, there is no limitation in the present invention, and there may exist three or more portions (a plurality of portions arranged in three or more stages) arranged at different stages from each other.

Furthermore, the bottom end of each of the ejection-port forming wall portions 82 is formed into a shape of chamfer as illustrated in FIGS. 3(*b*) and 3(*c*). Thus, the bottom end portion of each of the ejection-port forming wall portions 82 is formed into a shape that has a thickness reduced toward the lower side (shape of which dimension in the thickness direction becomes narrower toward the lower side).

This enables the foam to be less likely to adhere to the bottom end portion of the ejection-port forming wall portion 82, and hence, it is possible to favorably separate the bottom end portion of the ejection-port forming wall portion 82 from the shaped foam object 91. Thus, it is possible to separate the ejection-port forming wall portion 82 from the shaped foam object 91 while minimizing damage to the shape of the shaped foam object 91 that has been foamed.

As for the shape of chamfer of the bottom end portion of the ejection-port forming wall portion 82, either a round fillet shape or chamfering shape may be employed, and FIG. 3(*b*) shows that the round fillet shape is employed as an example.

In the case of this exemplary embodiment, the bottom end portion of each of the ejection-port forming wall portions 82 is formed into a shape that has a thickness reduced toward the lower side throughout the entire periphery of the ejection port 83, as illustrated in FIG. 3(*b*). However, the present invention is not limited to this example, and it may be possible that the bottom end portion of part of the ejection-port forming wall portion 82 in the circumferential direction has a shape that has a thickness reduced toward the lower side, whereby this part exhibits reduced adhesive force of the foam relative to this bottom end portion.

That is, it may be possible to employ a configuration in which the bottom end portion of at least part of the ejection-port forming wall portion 82 is formed into a shape that has a thickness reduced toward the lower side.

Although there is no specific limitation as to material of the foam discharging unit 80, inexpensive resin materials having a light weight (for example, polypropylene) are preferably used as the material of the foam discharging unit 80.

According to the first exemplary embodiment described above, the height position of the lower edge 821 of the first portion (ejection-port forming wall portion 82*a*) is higher than the height position of the lower edge 821 of the second portion (ejection-port forming wall portion 82*b*). Thus, it is possible to create a desired height difference for each portion of the shaped foam object 91 made out of the discharged foam bodies. This makes it possible to form a shaped object of foam having a desired three-dimensional shape with a more elaborate design.

Furthermore, the bottom end portion of at least part of the ejection-port forming wall portion 82 is formed into a shape that has a thickness reduced toward the lower side. This enables the foam to be less likely to adhere to the bottom end portion of the ejection-port forming wall portion 82, and hence, it is possible to favorably separate the bottom end portion of the ejection-port forming wall portion 82 from the shaped foam object 91. This makes it further easier to form a shaped object of foam having a desired three-dimensional shape with a more elaborate design.

Furthermore, since the discharging portion 20 includes the foam discharging unit 80 and the holding portion 234 that detachably holds the foam discharging unit 80, it is possible to change the shape of a shaped foam object 91 that can be formed, into one having another shape, by replacing the foam discharging unit 80 with one having an ejection-port forming wall portion 82 having another shape.

Modification Example of First Exemplary Embodiment

Next, a modification example of the first exemplary embodiment will be described with reference to FIG. 4(*a*), FIG. 4(*b*), FIG. 4(*c*), FIG. 16(*c*) and FIG. 16(*d*).

Figure 4A:
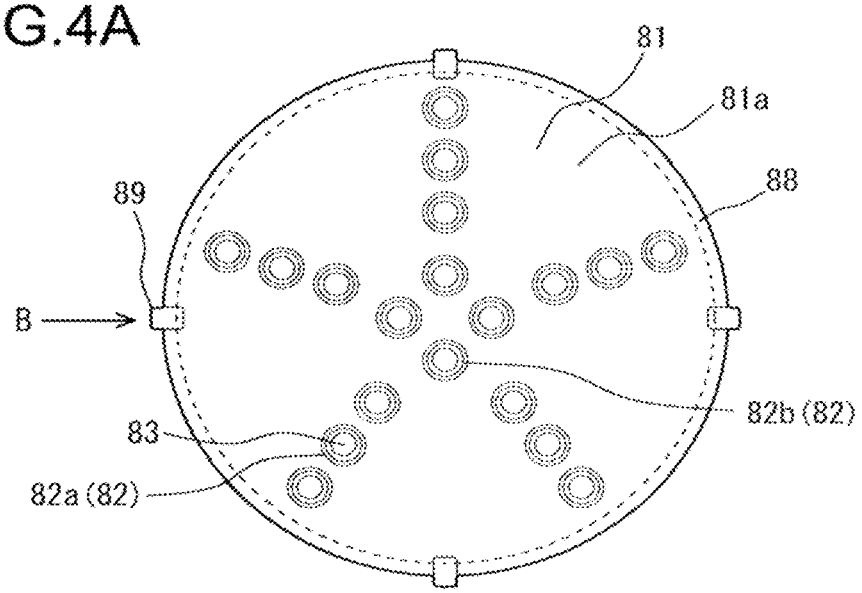
FIGS. 4(*a*), 4(*b*), and 4(*c*) are diagrams each illustrating a foam discharging unit of a foam discharging device according to a modification example of the first exemplary embodiment.
Figure 4B:
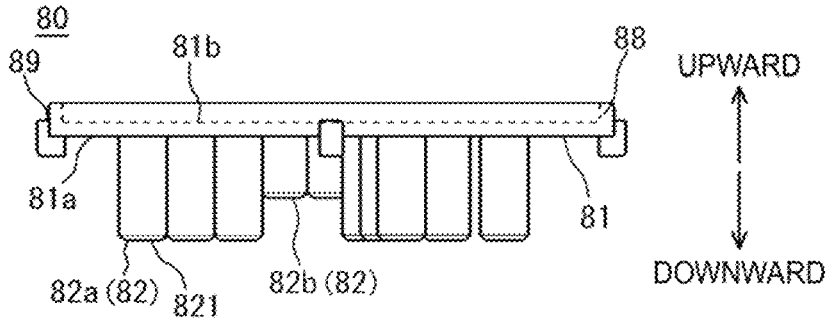
Figure 4C:
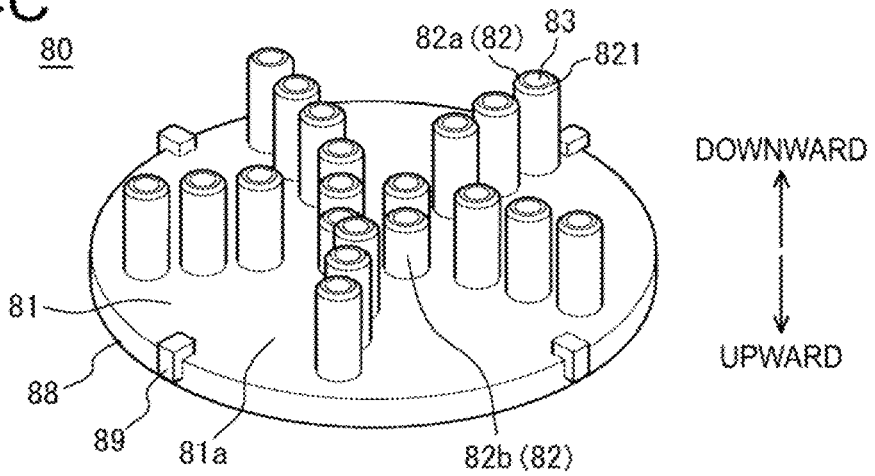

FIG. 16(*c*) is a planar image obtained by imaging a shaped foam object 91 actually formed using the foam discharging unit 80 illustrated in FIGS. 4(*a*) to 4(*c*), and FIG. 16(*d*) is a perspective image obtained by imaging the shaped foam object 91 from the direction of the arrow D in FIG. 16(*c*) (from the side surface direction).

In the case of the present modification example, the height relationship between the ejection-port forming wall portion 82*a* and the ejection-port forming wall portion 82*b* is reversed from that in first exemplary embodiment described above.

That is, as illustrated in FIGS. 4(*b*) and 4(*c*), the height position of the lower edge 821 of the ejection-port forming wall portion 82*b* is higher than the height position of the lower edge 821 of the ejection-port forming wall portion 82*a*. In addition, the ejection-port forming wall portion 82*b* serves as the first portion, and the ejection-port forming wall portion 82*a* serves as the second portion.

In the case of the present modification example, as the height position of the lower edge 821 of the ejection-port forming wall portion 82*b* is set to be higher than the height position of the lower edge 821 of the ejection-port forming wall portion 82*a*, it is possible to form a shaped foam object 91 shaped such that the central portions 91*b* is raised so as to be higher (formed so as to be thicker) than the petal portions 91*a* as illustrated in FIGS. 16(*c*) and 16(*d*).

Second Exemplary Embodiment

Next, the second exemplary embodiment will be described with reference to FIG. 5(*a*), FIG. 5(*b*), FIG. 5(*c*), FIG. 6, FIG. 17(*a*), and FIG. 17(*b*).

Figure 5A:
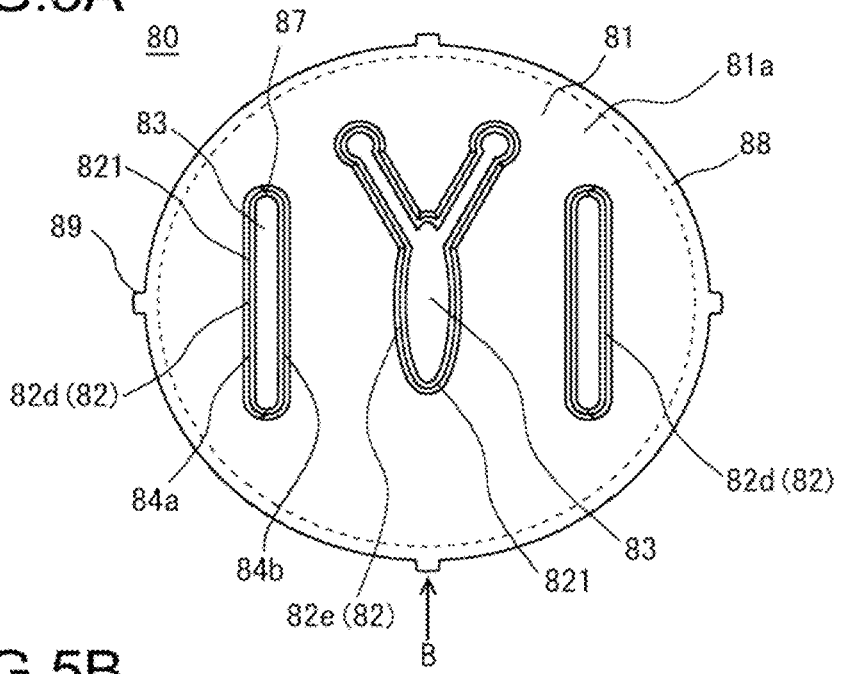
FIGS. 5(*a*), 5(*b*), and 5(*c*) are diagrams each illustrating a foam discharging unit of a foam discharging device according to a second exemplary embodiment.
Figure 5B:
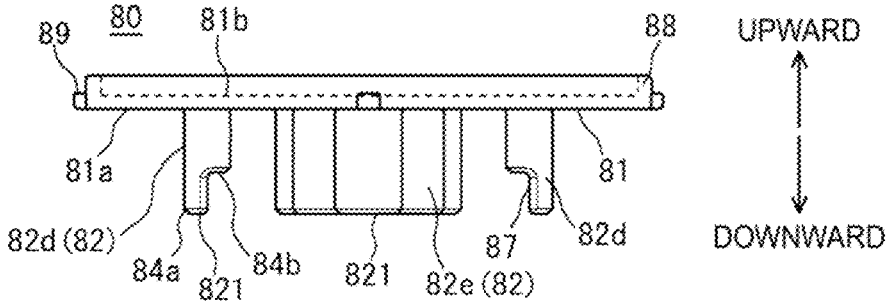
Figure 5C:
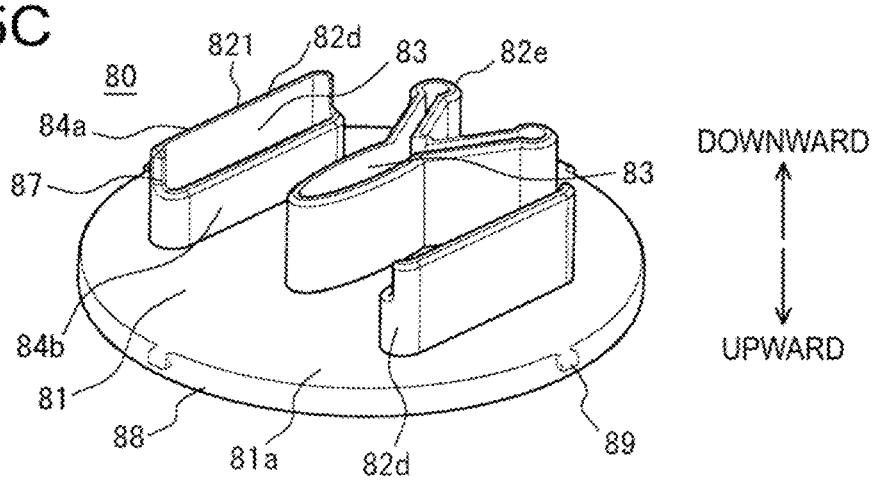
Figure 6:
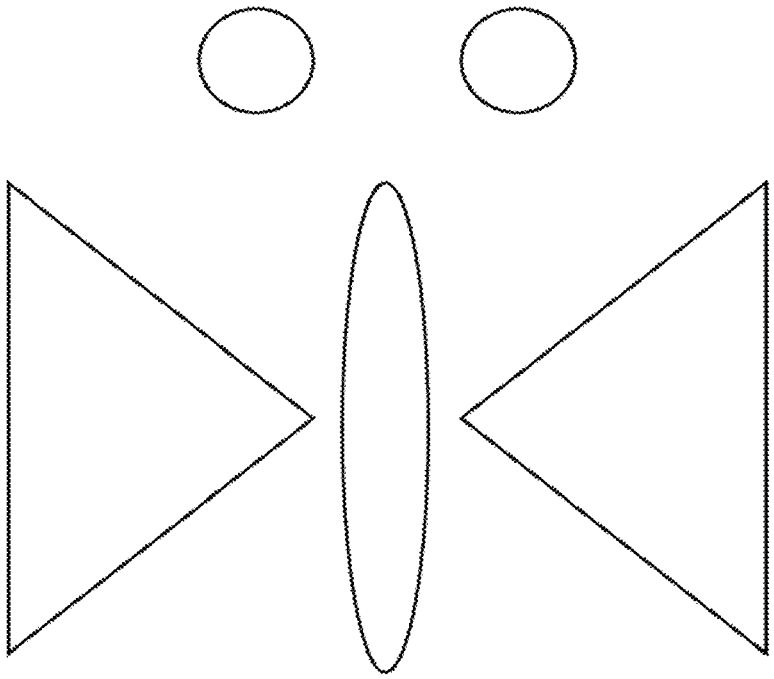
FIG. 6 is a schematic view illustrating the planer shape of a shaped foam object aimed at in the second exemplary embodiment.

FIG. 17(*a*) is a planar image obtained by imaging a shaped foam object 92 actually formed using the foam discharging unit 80 illustrated in FIGS. 5(*a*) to 5(*c*), and FIG. 17(*b*) is a perspective image obtained by imaging the shaped foam object 92 from the direction of the arrow B in FIG. 17(*a*) (from the side surface direction).

The foam discharging device 100 and the foam discharging unit 80 according to this exemplary embodiment differ from the foam discharging device 100 and the foam discharging unit 80 according to the first exemplary embodiment described above in terms of the shape of the ejection-port forming wall portion 82, and explanation of the portions common to the foam discharging device 100 and the foam discharging unit 80 according to the first exemplary embodiment described above will not be repeated.

In the following description, the positional relationship and the shape of each of the ejection-port forming wall portions 82 of the foam discharging unit 80 may be described on the basis of the positional relationship illustrated in each of the drawings.

In the case of this exemplary embodiment, the foam discharging unit 80 is a unit for forming a shaped foam object 92 (FIGS. 17(*a*) and 17(*b*)) shaped like a butterfly. The target shape (planer shape) of a shaped foam object 92 formed in this exemplary embodiment is illustrated in FIG. 6.

As illustrated in FIGS. 5(*a*) to 5(*c*), the ejection-port forming wall portions (group of ejection-port forming wall portions) of the foam discharging unit 80 include a pair of left and right ejection-port forming wall portions 82*d* and an ejection-port forming wall portion 82*e* disposed at the center.

Each of the ejection-port forming wall portions 82*d* is a portion for forming a butterfly-wing portion 92*a* (FIGS. 17(*a*) and 17(*b*)), and is formed into a slit shape elongated in one direction in plan view. The pair of ejection-port forming wall portions 82*d* extend so as to be parallel to each other. The wall surface of each portion of each of the ejection-port forming wall portions 82*d* is perpendicular to the plate-like portion 81. The ejection-port forming wall portion 82*d* and the ejection-port forming wall portion 82*e* each have a non-circular shape in plan view, and the group of ejection-port forming wall portions, which is a collective body of the pair of ejection-port forming wall portions 82*d* and one ejection-port forming wall portion 82*e*, forms a non-circular shape in plan view as a whole. Furthermore, the group of ejection-port forming wall portions is comprised of a combination of the ejection-port forming wall portions 82*d* and the ejection-port forming wall portion 82*e*, which have shapes different from each other in plan view.

As illustrated in FIGS. 5(*b*) and 5(*c*), the ejection-port forming wall portion 82*d* includes a low-position end portion 84*a* and a high-position end portion 84*b*, and the height position of the lower edge 821 of the high-position end portion 84*b* is higher than the height position of the lower edge 821 of the low-position end portion 84*a*.

More specifically, a one-half portion of sides, which face each other, of each of the ejection-port forming wall portions 82*d* serves as a high-position end portion 84*b*, and the remaining portion serves as a low-position end portion 84*a*. In each of the ejection-port forming wall portions 82*d*, the low-position end portion 84*a* is disposed on the outer side of the discharging portion 20 in plan view, whereas the high-position end portion 84*b* is disposed on the inner side of the discharging portion 20. Thus, in the group of ejection-port forming wall portions, which is a collective body of the plurality of ejection-port forming wall portions 82*d*, 82*d*, 82*e*, the low-position end portion 84*a* is disposed on the outer side, and the high-position end portion 84*b* is disposed on the inner side. In other words, the low-position end portion 84*a* is disposed on the peripheral side (outer side) of the area where the plurality of ejection-port forming wall portions 82 are arranged, and the high-position end portion 84*b* is disposed on the central side (inner side). A transitional portion 87 where the height position of the lower edge 821 changes lies at the boundary between the low-position end portion 84*a* and the high-position end portion 84*b*. In the case of this exemplary embodiment, the transitional portion 87 is configured as a stepped portion. The transitional portion 87 is formed at each of both ends of each of the ejection-port forming wall portions 82*d* in the longitudinal direction.

From the viewpoint of the shaping property of the shaped foam object 92, it is preferable that the difference in height between the high-position end portion 84*b* and the low-position end portion 84*a* is equal to or more than 1 mm, more preferably, equal to or more than 2 mm. In addition, it is preferable that the difference is equal to or less than 8 mm, more preferably, equal to or less than 5 mm. Furthermore, it is preferable that it is equal to or more than 1 mm and equal to or less than 8 mm, more preferably, equal to or more than 2 mm and equal to or less than 5 mm.

Furthermore, from a similar viewpoint, it is preferable that the length of the ejection-port forming wall portion 82*d* from the plate-like portion 81 to the lower edge 821 is equal to or more than 2 mm, more preferably, equal to or more than 3 mm, still more preferably, equal to or more than 5 mm. In addition, it is preferable that this length is equal to or less than 30 mm, more preferably, equal to or less than 25 mm, still more preferably, equal to or less than 20 mm. Furthermore, it is preferable that it is equal to or more than 2 mm and equal to or less than 30 mm, more preferably, equal to or more than 3 mm and equal to or less than 25 mm, still more preferably, equal to or more than 5 mm and equal to or less than 20 mm.

The height position of the lower edge 821 of the high-position end portion 84*b* is configured to be uniform. Similarly, the height position of the lower edge 821 of the low-position end portion 84*a* is configured to be uniform. The low-position end portion 84*a* is formed into a flat plate shape that is vertically erected throughout the entire region, and the lower edge 821 of the low-position end portion 84*a* is formed so as to be horizontal and in a straight shape almost throughout the entire region in the longitudinal direction. In other words, the low-position end portion 84*a* (second portion) includes a portion formed into a flat plate shape that is vertically erected, and the lower edge of this flat-plate shaped portion extends horizontally. In addition, the lower edge of the flat-plate shaped portion is formed into a straight shape.

Here, in each of the ejection-port forming wall portions 82*d*, the low-position end portion 84*a* and the high-position end portion 84*b* extend so as to be arranged alongside each other (for example, in parallel to each other) in plan view, and also extend almost throughout the entire region in the longitudinal direction of the ejection-port forming wall portion 82*d* in plan view. Thus, a portion of the low-position end portion 84*a* that protrudes downward further than the high-position end portion 84*b* exists in a region having a certain length (for example, it exists almost throughout the entire region in the longitudinal direction of the ejection-port forming wall portion 82*d*).

As described above, in each of the ejection-port forming wall portions 82*d*, the lower edge 821 of each of the low-position end portion 84*a* and the high-position end portion 84*b* has a portion that extends horizontally (for example, extends horizontally in a straight shape). In addition, the portion of the lower edge 821 of the low-position end portion 84*a* that extends horizontally in a straight shape and the portion of the lower edge 821 of the high-position end portion 84*b* that extends horizontally in a straight shape extend so as to be arranged alongside each other (for example, in parallel to each other) in plan view.

Furthermore, from the viewpoint of the shaping property of the shaped foam object 92, it is preferable that the ratios of the low-position end portion 84*a* and the high-position end portion 84*b* occupying each of the ejection-port forming wall portions 82 in the circumferential direction are equivalent to each other, or the ratio of occupation by the low-position end portion 84*a* is greater than the ratio of occupation by the high-position end portion 84*b*.

The ejection-port forming wall portion 82*e* is a portion for forming a body portion 92*b* and a pair of antenna portions 92*c* of the butterfly (FIGS. 17(*a*) and 17(*b*)). The ejection-port forming wall portion 82*e* has a shape that includes a portion (a portion for forming the body portion 92*b* of the butterfly) that extends so as to be substantially in parallel to the ejection-port forming wall portion 82*d* in plan view, and a pair of portions (portions for forming the pair of antenna portions 92*c* of the butterfly) that protrude from that portion in a V-shape so as to be symmetrical in the left-right direction and each have a tip end that expands in a circular shape. The wall surface of each portion of the ejection-port forming wall portion 82*e* is perpendicular to the plate-like portion 81.

In the case of this exemplary embodiment, the height position of the lower edge 821 of the ejection-port forming wall portion 82*e* is set so as to be equal to the height position of the lower edge 821 of the low-position end portion 84*a* of the ejection-port forming wall portion 82*d*, and is configured to be uniform.

From the viewpoint of the shaping property of the shaped foam object 92, it is preferable that the planer shape of the space surrounded by each of the ejection-port forming wall portions 82*d*, which includes the low-position end portion 84*a* and the high-position end portion 84*b*, has a flat shape having a long axis and a short axis. In this case, it is preferable that the long axis has a length equal to or more than 1.2 times longer than the short axis, more preferably, equal to or more than twice longer than the short axis. In addition, it is preferable that the length of the long axis is equal to or less than 30 times longer than the length of the short axis, more preferably, equal to or less than 20 times longer than the length of the short axis.

In the case of this exemplary embodiment, the high-position end portion 84*b* serves as the first portion, and the low-position end portion 84*a* serves as the second portion.

That is, one of the ejection-port forming wall portions 82 (ejection-port forming wall portion 82*d*) includes the first portion (high-position end portion 84*b*) and the second portion (low-position end portion 84*a*).

Furthermore, in the case of this exemplary embodiment, it may be possible to consider that the high-position end portion 84*b* serves as the first portion, and the ejection-port forming wall portion 82*e* serves as the second portion. In other words, it may be possible to consider that part (high-position end portion 84*b*) of the ejection-port forming wall portion 82*d* forms the first portion, and the ejection-port forming wall portion 82*e* forms the second portion. That is, the discharging portion 20 has the plurality of ejection-port forming wall portions 82, and the plurality of ejection-port forming wall portions 82 include the first-portion configuring wall portion (ejection-port forming wall portion 82*d*) that configures the first portion (high-position end portion 84*b*), and the second-portion configuring wall portion (ejection-port forming wall portion 82*e*) that configures the second portion.

Furthermore, the bottom end portion of each of the ejection-port forming wall portions 82 is shaped into chamfer as illustrated in FIGS. 5(*b*) and 5(*c*). Thus, the bottom end portion of the ejection-port forming wall portion 82 is formed into a shape that has a thickness reduced toward the lower side (shape of which dimension in the thickness direction becomes narrower toward the lower side).

The shape of chamfer of the bottom end portion of the ejection-port forming wall portion 82 may be either a round fillet shape or a chamfering shape, and the chamfering shape is shown in FIG. 5(*b*) as an example.

In the case of this exemplary embodiment, since the one-half portions, which are located on opposing sides to each other, of the pair of ejection-port forming wall portion 82*d* are each configured as the high-position end portion 84*b* (the length of downward extension of the wall is short), more foam body flows out from the high-position end portion 84*b* side. In other words, many of the foam body discharged from the ejection-port forming wall portion 82*d* flows out toward the ejection-port forming wall portion 82*e* side, which is located at the center. As a result, the foam body discharged from the ejection-port forming wall portion

82*d* has a shape that expands toward the ejection-port forming wall portion 82*e* side, which is located at the center, so as to be in a half-round shape. In addition, the low-position end portion 84*a* (having a longer length of the wall that extends downward) restricts flow-out of the foam body toward the side direction, and hence, the shape of the foam body along the low-position end portion 84*a* is formed into a straight shape that reflects the planer shape of the low-position end portion 84*a*.

Here, the low-position end portion 84*a* includes a portion that is formed into a flat plate shape that is erected vertically, and the lower edge of this flat-plate shaped portion extends horizontally. That is, the low-position end portion 84*a* is formed so as to have a uniform height throughout the entire region, and the portion of the low-position end portion 84*a* that protrudes downward further than the high-position end portion 84*b* is formed into a flat plate shape. With this configuration, this flat-plate shaped portion functions as a spatula, and the foam body is discharged while being stroked by this spatula. Thus, it is possible to form a three-dimensional shaped foam object 92 that has the outer end portion formed into a straight shape in plan view, which makes it possible to form the outline of the shaped foam object 92 in a well-defined manner.

The foam body discharged from the ejection-port forming wall portion 82*d* flows out toward the high-position end portion 84*b* side and is less likely to spread toward the low-position end portion 84*a* side, and hence, it is possible to sufficiently obtain the spatula effect of the low-position end portion 84*a* to form a surface that is erected in a wall shape, whereby it is possible to obtain a shaped foam object with an elaborate design.

Thus, the foam bodies discharged from the pair of ejection-port forming wall portions 82*d* form the pair of wing portions 92*a* shaped like a pair of wings of a butterfly (FIG. 17(*a*), FIG. 17(*b*)).

In addition, the foam body discharged from the ejection-port forming wall portion 82*e* forms the body portion 92*b* shaped like the body of a butterfly, and the pair of antenna portions 92*c* shaped like antennae, and these body portion 92*b* and antenna portions 92*c* are formed integrally with the pair of wing portions 92*a* (FIG. 17(*a*), FIG. 17(*b*)).

In the case of this exemplary embodiment, it is possible to form the shaped foam object 92 shaped like a butterfly so as to have a three-dimensional shape with a highly elaborate design.

Modification Example 1 of Second Exemplary Embodiment

A modification example 1 of the second exemplary embodiment will be described with reference to FIG. 7(*a*), FIG. 7(*b*), FIG. 7(*c*), FIG. 17(*c*), and FIG. 17(*d*).

Figure 7A:
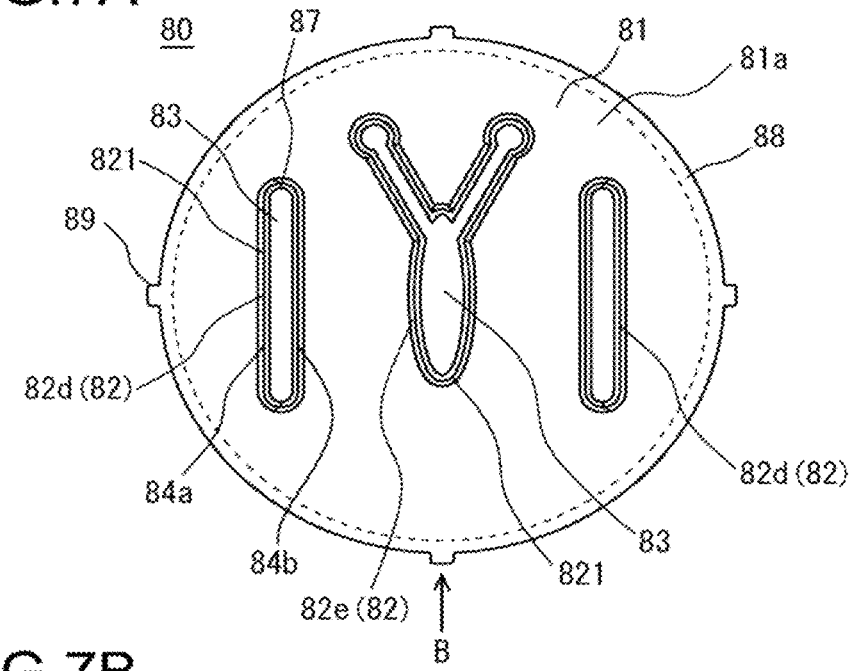
FIGS. 7(*a*), 7(*b*), and 7(*c*) are diagrams each illustrating a foam discharging unit of a foam discharging device according to a modification example 1 of the second exemplary embodiment.
Figure 7B:
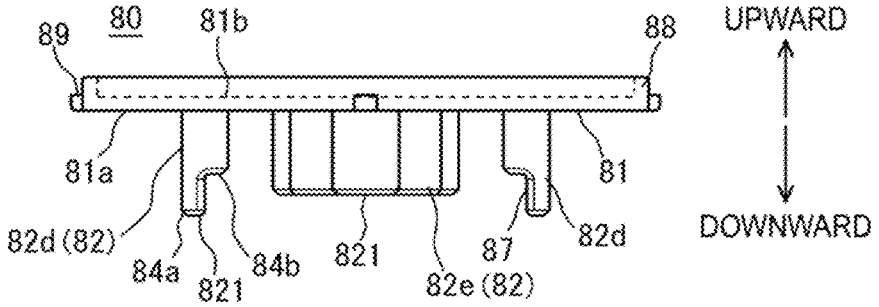
Figure 7C:
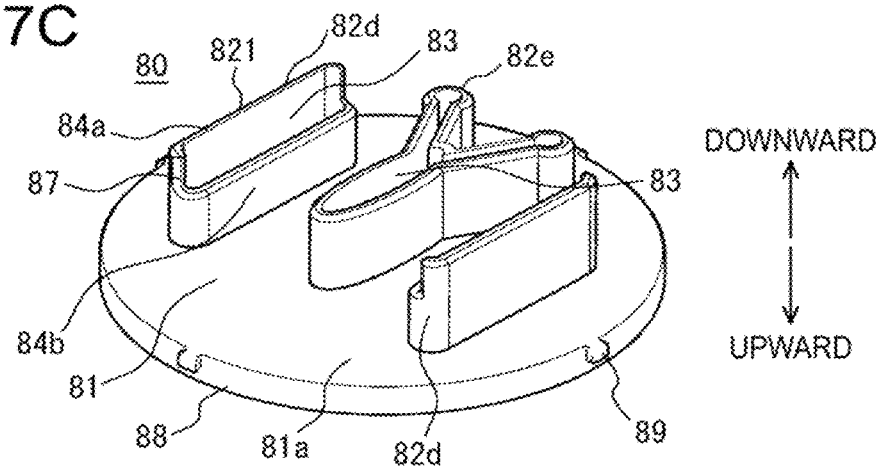

FIG. 17(*c*) is a planer image obtained by imaging a shaped foam object 92 actually formed using the foam discharging unit 80 illustrated in FIGS. 7(*a*) to 7(*c*), and FIG. 17(*d*) is a perspective image obtained by imaging the shaped foam object 92 from the direction of the arrow D in FIG. 17(*c*) (from the side surface direction).

The present modification example differs from the second exemplary embodiment (FIGS. 5(*a*) to 5(*c*)) in that the height position of the lower edge 821 of the ejection-port forming wall portion 82*e* is higher than the height position of the lower edge 821 of the lower edge 821 of the low-position end portion 84*a*, and is lower than the height position of the lower edge 821 of the high-position end portion 84*b*, as illustrated in FIGS. 7(*a*), 7(*b*), and 7(*c*).

In the case of the present modification example, the height position of the lower edge 821 of the ejection-port forming wall portion 82*e* is higher as compared with that in the second exemplary embodiment described above. Thus, as compared with the second exemplary embodiment, it is possible to form a shaped foam object 92 shaped such that the body portion 92*b* is raised in an oval shape so as to be high (formed so as to be thick), as illustrated in FIGS. 17(*c*) and 17(*d*).

Modification Example 2 of Second Exemplary Embodiment

Next, a modification example 2 of the second exemplary embodiment will be described with reference to FIGS. 8(*a*) and 8(*b*).

In the case of the present modification example, the foam discharging unit 80 includes one ejection-port forming wall portion 82*j*. This ejection-port forming wall portion 82*j* is shaped such that the pair of ejection-port forming wall portions 82*d* and the ejection-port forming wall portion 82*e* located at the center in the second exemplary embodiment illustrated in FIG. 5(*a*) to FIG. 5(*c*) are connected with each other through a connecting portion 86.

That is, the ejection-port forming wall portion 82*j* has a second low-position end portion 84*c* located at the center thereof and having a shape similar to the ejection-port forming wall portion 82*e* in the second exemplary embodiment, and also has a pair of low-position end portion 84*a* and high-position end portion 84*b*, which are similar to those in the second exemplary embodiment, the pair being disposed at the right and the left, respectively. In addition, the central portions, in the longitudinal direction, of the left and right high-position end portion 84*b* are each connected, through the connecting portion 86 having a slit shape in plan view, with the central portion, in the longitudinal direction, of the portion of the second low-position end portion 84*c* that forms the body of a butterfly. The ejection-port forming wall portion 82*j* has a closed-loop shape in planer shape as a whole, and has one ejection port 83. In addition, the ejection-port forming wall portion 82*j* that forms one ejection port 83 has a non-circular shape in plan view, and portions corresponding to the ejection-port forming wall portion 82*d* and the ejection-port forming wall portion 82*e* according to the second exemplary embodiment and the connecting portion 86 each have a non-circular shape in plan view. Furthermore, the ejection port 83 (ejection-port forming wall portion 82*j*) is comprised of a combination of the connecting portion 86 having a rectangle shape and the portions corresponding to the ejection-port forming wall portion 82*d* having a slit shape elongated in one direction and the ejection-port forming wall portion 82*e* shaped like the antennae and the body of a butterfly. In other words, the ejection port 83 (ejection-port forming wall portion 82*j*) is comprised of a combination of plural portions (a portion corresponding to the ejection-port forming wall portion 82*d*, a portion corresponding to the ejection-port forming wall portion 82*e*, and the connecting portion 86) having shapes different from each other in plan view.

Furthermore, as for a portion of the ejection-port forming wall portion 82*j* that corresponds to the pair of ejection-port forming wall portions 82*d*, the low-position end portion 84*a* is disposed on the outer side of the discharging portion 20 in plan view, and the high-position end portion 84*b* is disposed on the inner side of the discharging portion 20.

In addition, the transitional portion 87 where the height position of the lower edge 821 changes is formed in the connecting portion 86. In the case of this exemplary embodiment, the transitional portion 87 is a sloped section in which the height position of the lower edge 821 gradually changes.

In this modification example, it is possible to form a shaped foam object having a shape similar to that in the second exemplary embodiment.

Modification Example 3 of Second Exemplary Embodiment

Next, a modification example 3 of the second exemplary embodiment will be described with reference to FIGS. 8(*a*) and 8(*c*).

Figure 8A:
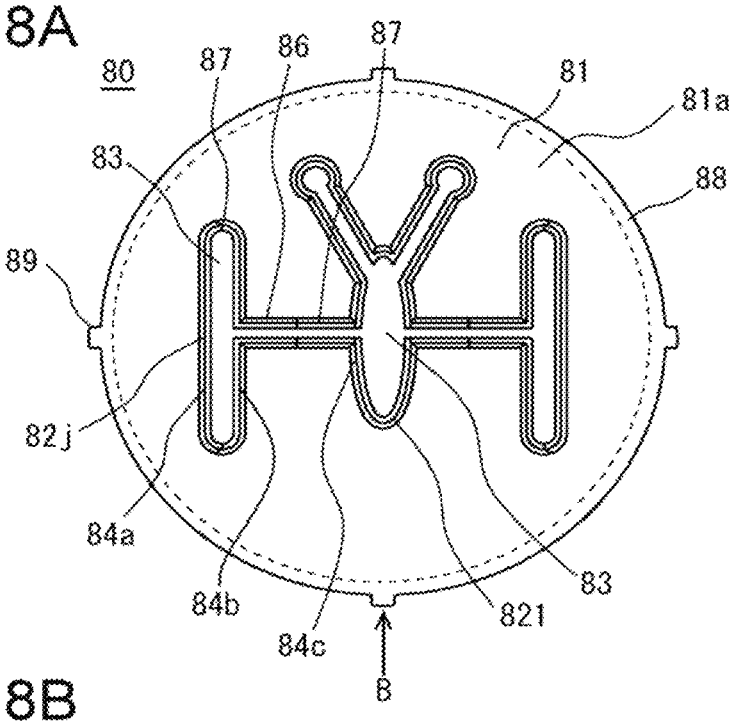
FIGS. 8(*a*), 8(*b*), and 8(*c*) are diagrams each illustrating a foam discharging unit of a foam discharging device according to modification examples 2 and 3 of the second exemplary embodiment.
Figure 8B:
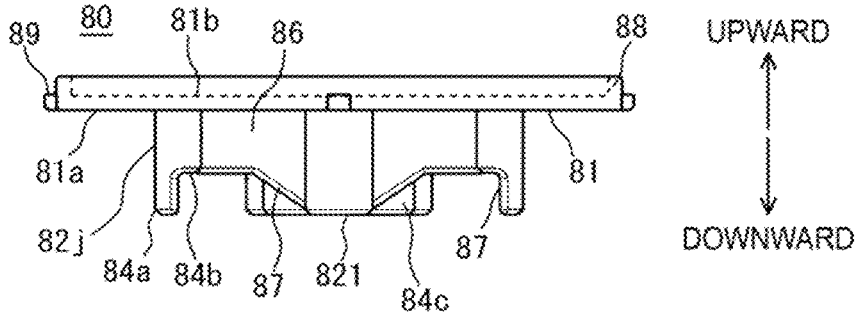
Figure 8C:
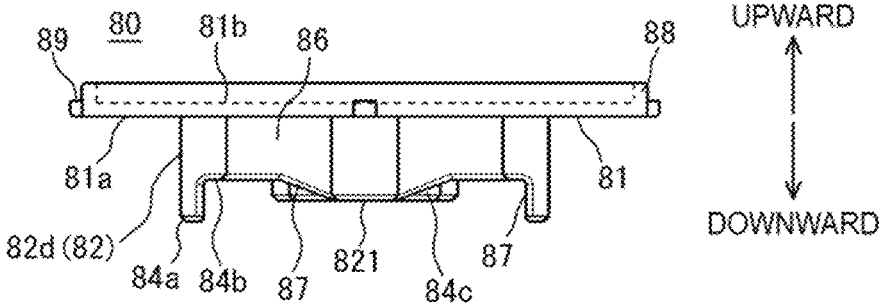

The present modification example differs from the modification example 2 illustrated in FIG. 8(*b*) in that the second low-position end portion 84*c* at the center of the ejection-port forming wall portion 82*j* is similar to that in the modification example 1 illustrated in FIG. 7(*a*) to FIG. 7(*c*), and in other points, the present modification example is similar to the modification example 2 illustrated in FIG. 8(*b*).

With the present modification example, it is possible to form a shaped foam object having a shape similar to that with the modification example 1 of the second exemplary embodiment.

Third Exemplary Embodiment

Next, a third exemplary embodiment will be described with reference to FIG. 9(*a*), FIG. 9(*b*), FIG. 9(*c*), FIG. 18(*a*), and FIG. 18(*b*).

Figure 9A:
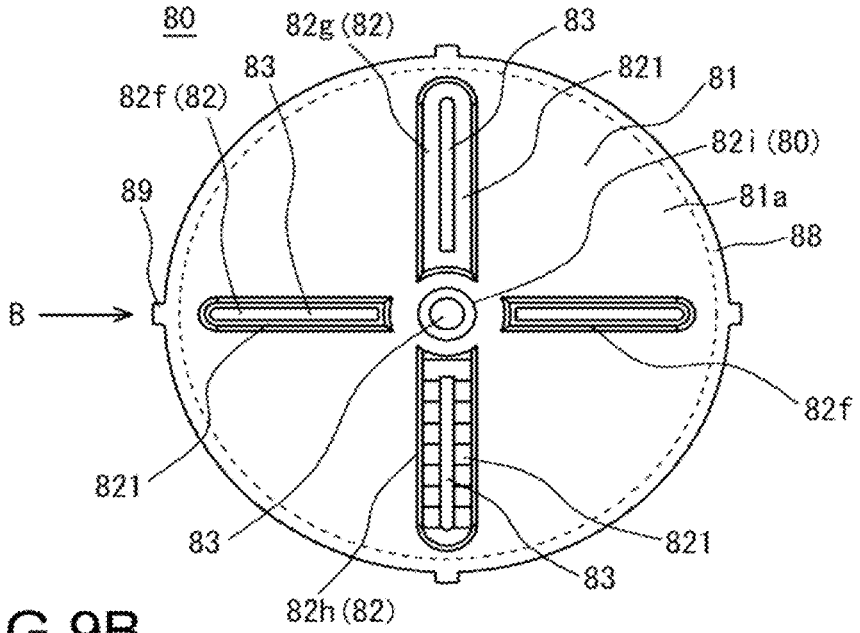
FIGS. 9(*a*), 9(*b*), and 9(*c*) are diagrams each illustrating a foam discharging unit of a foam discharging device according to the third exemplary embodiment.
Figure 9B:
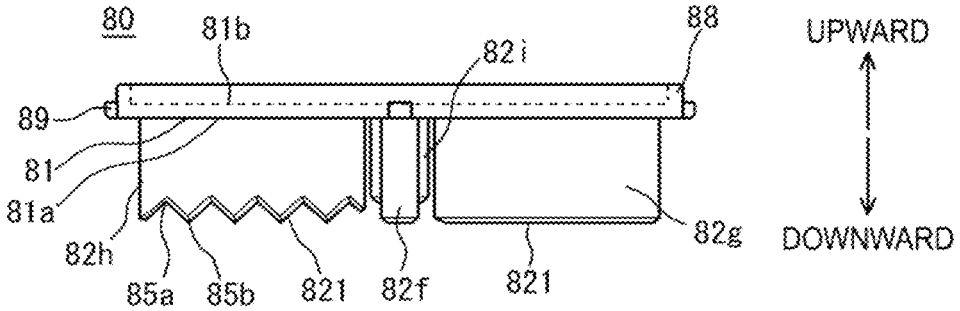
Figure 9C:
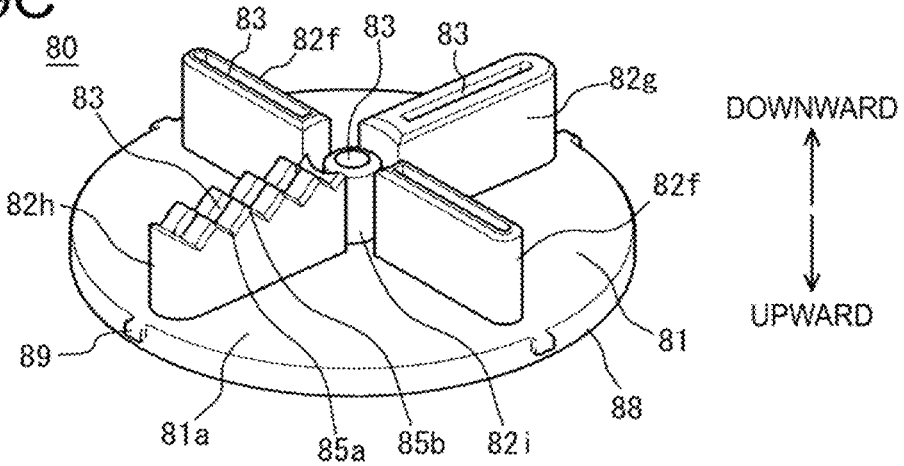
Figure 18B:
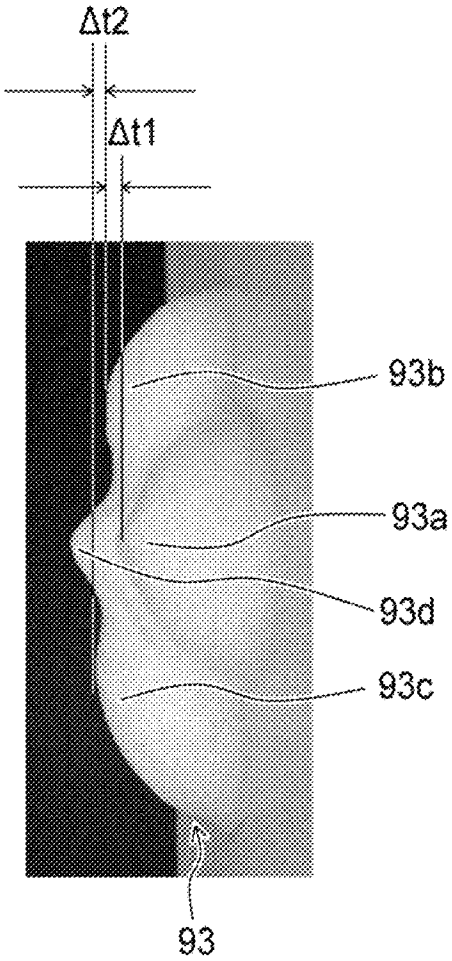
FIGS. 18(*a*) and 18(*b*) are diagrams each illustrating an example of a shaped object of foam.
Figure 18A:
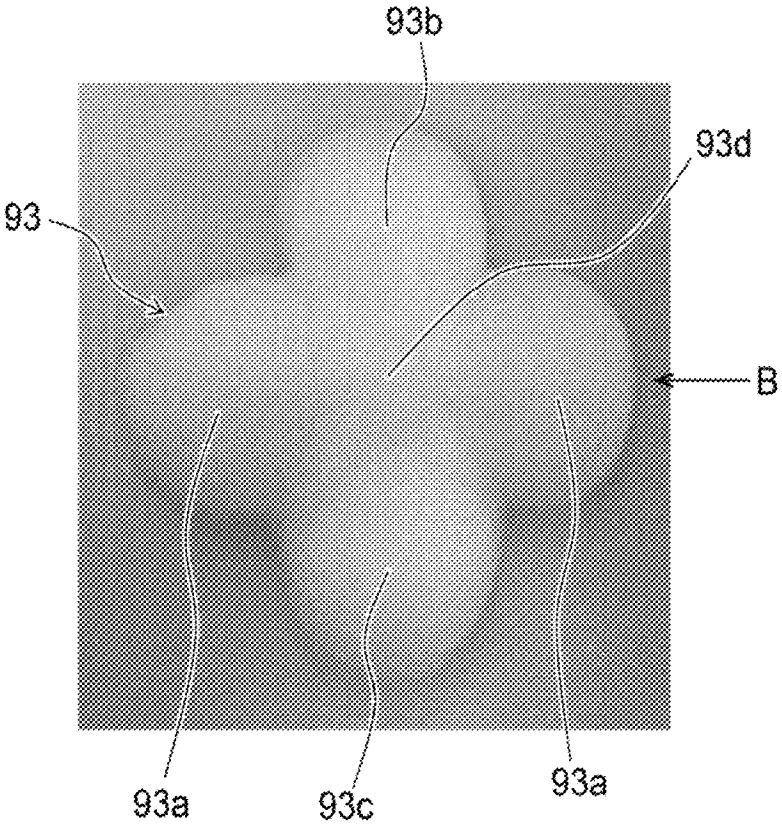

FIG. 18(*a*) is a planar image obtained by imaging a shaped foam object 93 actually formed using the foam discharging unit 80 illustrated in FIGS. 9(*a*) to 9(*c*), and FIG. 18(*b*) is a side image obtained by imaging a shaped foam object 93 from the direction of the arrow B in FIG. 18(*a*) (from the side surface direction).

The foam discharging device 100 and the foam discharging unit 80 according to this exemplary embodiment differ from the foam discharging device 100 and the foam discharging unit 80 according to the first exemplary embodiment described above in terms of the shape of the ejection-port forming wall portion 82, and explanation of the portions common to those in the foam discharging device 100 and the foam discharging unit 80 according to the first exemplary embodiment described above will not be repeated as appropriate.

In the following description, the positional relationship and the shape of each of the ejection-port forming wall portions 82 of the foam discharging unit 80 may be described on the basis of the positional relationship illustrated in each of the drawings.

As illustrated in FIGS. 9(*a*) and 9(*c*), in the case of this exemplary embodiment, the foam discharging unit 80 includes five ejection-port forming wall portions 82 in total: one ejection-port forming wall portion 82*i* disposed at the center; a pair of left and right ejection-port forming wall portions 82*f* disposed so as to be symmetrical in the left-right direction with the ejection-port forming wall portion 82*i* being disposed therebetween; and an ejection-port forming wall portion 82*g* and an ejection-port forming wall portion 82*h* disposed so as to be symmetrical in the front-back direction with the ejection-port forming wall portion 82*i* being disposed therebetween.

The ejection-port forming wall portion 82*i* is formed into a circular tubular shape, and the ejection-port forming wall portions 82*f* are each formed into a slit shape elongated in one direction in plan view, and extend on the same straight line.

Furthermore, the ejection-port forming wall portion 82*g* and the ejection-port forming wall portion 82*h* are each formed into a slit shape elongated in one direction in plan view, extend on the same straight line, and extend in a direction perpendicular to the ejection-port forming wall portion 82*f*.

Thus, the ejection-port forming wall portion 82*i*, the ejection-port forming wall portions 82*f*, the ejection-port forming wall portion 82*g*, and the ejection-port forming wall portion 82*h* form the shape of a cross in plan view.

The wall surfaces of portions of the ejection-port forming wall portion 82*i*, the ejection-port forming wall portions 82*f*, the ejection-port forming wall portion 82*g*, and the ejection-port forming wall portion 82*h* are perpendicular to the plate-like portion 81.

Furthermore, the bottom end portions of the ejection-port forming wall portion 82*i*, the ejection-port forming wall portions 82*f*, the ejection-port forming wall portion 82*g*, and the ejection-port forming wall portion 82*h* are each formed into the shape of chamfer as illustrated in FIGS. 9(*b*) and 9(*c*). With this configuration, the bottom end portion of each of the ejection-port forming wall portions 82 is formed into a shape that has a thickness reduced toward the lower side (shape of which dimension in the thickness direction becomes narrower toward the lower side).

In addition, the height position of the lower edge 821 of the ejection-port forming wall portion 82*i*, the height position of the lower edge 821 of the ejection-port forming wall portions 82*f*, and the height position of the lower edge 821 of the ejection-port forming wall portion 82*g* are each configured to be uniform.

The height positions of the lower edges 821 of the ejection-port forming wall portions 82*f*, the ejection-port forming wall portion 82*g*, and the ejection-port forming wall portion 82*h* are each set to be equal to each other, and are set so as to be lower than the height position of the lower edge 821 of the ejection-port forming wall portion 82*i*.

Furthermore, as described later, the lower edge 821 of the ejection-port forming wall portion 82*h* has a sawtooth, uneven shape such that a protruding portion 85*b* with a crest shape and a recessed portion 85*a* with a trough shape are alternately formed. In this description, the height position of the lower edge 821 of the ejection-port forming wall portion 82*h*, which is equal to the height positions of the lower edges 821 of the ejection-port forming wall portions 82*f* and the ejection-port forming wall portion 82*g*, represents the height position of the protruding portion 85*b*, which is the lowest end.

Here, as illustrated in FIG. 9(*a*), the wall thickness of the ejection-port forming wall portion 82*g* is thicker than the wall thickness of each of the ejection-port forming wall portions 82*f*.

With this configuration, the width size, in the thickness direction, of the lower edge 821 of the ejection-port forming wall portion 82*g* is greater than that of the lower edge 821 of each the ejection-port forming wall portions 82*f*. The ejection-port forming wall portion 82*g* having the lower edge 821 with a greater width size serves as the first wall portion, and the ejection-port forming wall portion 82*f* having the lower edge 821 with a width size smaller than that of the first wall portion serves as the second wall portion.

Thus, the adhesive property (adhesive property resulting from the surface tension) of a foam body relative to the lower edge 821 of the ejection-port forming wall portion 82*g* (first wall portion) is stronger than the adhesive property of the foam body relative to the lower edge 821 of the ejection-port forming wall portion 82*f* (second wall portion).

In other words, of the ejection-port forming wall portion 82*g* and the ejection-port forming wall portions 82*f*, the ejection-port forming wall portion 82*g* serves as the first wall portion, and the ejection-port forming wall portions 82*f* serves as the second wall portion.

As described above, in the case of this exemplary embodiment, (1) the bottom end portion of at least part of the ejection-port forming wall portion 82 is formed into a shape that has a thickness reduced toward the lower side; the ejection-port forming wall portion 82 includes a first portion and a second portion; and the height position of a lower edge of the first portion is higher than the height position of a lower edge of the second portion, and (2) the ejection-port forming wall portion 82 includes the first wall portion and the second wall portion; and the adhesive property of the foam body relative to the lower edge of the first wall portion is stronger than the adhesive property of the foam body relative to the lower edge of the second wall portion.

The width size of the lower edge 821 of the first wall portion may be set to be an average of width sizes of individual portions (individual portions of the ejection-port forming wall portion 82*g* in the circumferential direction) of the first wall portion. Similarly, the width size of the lower edge 821 of the second wall portion may be set to be an average of width sizes of individual portions (individual portions of the ejection-port forming wall portions 82*f* in the circumferential direction) of the second wall portion.

In this exemplary embodiment, each of the first wall portion and the second wall portion is the entirety of each of the ejection-port forming wall portion 82. That is, the discharging portion 20 includes a plurality of ejection-port forming wall portions 82, and the plurality of ejection-port forming wall portions 82 include a first-wall-portion configuring wall portion (for example, the ejection-port forming wall portion 82*g*) that configures the first wall portion, and a second-wall-portion configuring wall portion (for example, the ejection-port forming wall portion 82*f*) that configures the second wall portion.

Hereinbelow, the adhesive property of a foam body relative to the lower edge 821 of the ejection-port forming wall portion 82 is also referred to simply as an adhesive property.

The adhesive property of a foam body represents a degree at which a foam body is likely to adhere due to the surface tension, and the foam body is more likely to adhere as the adhesive property becomes stronger. In addition, the adhesive property of a foam body means an adhesive property per unit length of the ejection-port forming wall portion 82 in the circumferential direction.

The degree of the adhesive property of a foam body can be determined by evaluating how far the foam body is pulled by the ejection-port forming wall portion 82 in the direction in which the ejection-port forming wall portion 82 is relatively moved with respect to the foam body when the ejection-port forming wall portion 82 is detached from the foam body discharged from the ejection port 83. That is, with increase in the distance of the foam body being pulled by the ejection-port forming wall portion 82, the adhesive property of a foam body relative to the lower edge 821 of the ejection-port forming wall portion 82 increases. More specifically, in the case where the ejection-port forming wall portion 82 protrudes downward, the ejection-port forming wall portion 82 is moved upward relatively to the foam body when the ejection-port forming wall portion 82 is detached from the foam body discharged from the ejection port 83 (for example, by moving downward the foam body together with the discharging destination such as a hand). As described above, the adhesive property of a foam body relative to the tip end edge (lower edge 821) of the ejection-port forming wall portion 82 becomes stronger with increase in the distance of the foam body being pulled upward when the ejection-port forming wall portion 82 is detached from the foam body.

Determining of the degree of the adhesive property of a foam body is not limited to the example described above. For example, first, a test piece is cut out from an ejection-port forming wall portion 82 of the foam discharging device 100 so that the test piece includes the tip end edge of the ejection-port forming wall portion 82. After this, when the test piece is pressed against the foam body and then, the test piece is pulled upward, the distance of the foam body being pulled upward by the test piece is measured. As the measured distance increases, it can be determined that the adhesive property of the foam body becomes stronger.

Here, in the case where the bottom end portion of the ejection-port forming wall portion 82 is formed into the shape of chamfer, the width size of the lower edge 821 represents the width size of the lower surface excluding the chamfer portion (rather than the width size including the chamfer portion).

The width size of the lower edge 821 of the first wall portion may be set to be an average of width sizes of individual portions (individual portions of the ejection-port forming wall portion 82*g* in the circumferential direction) of the first wall portion. Similarly, the width size of the lower edge 821 of the second wall portion may be set to be an average of width sizes of individual portions (individual portions of the ejection-port forming wall portions 82*f* in the circumferential direction) of the second wall portion.

In this exemplary embodiment, each of the first wall portion and the second wall portion is the entirety of each of the ejection-port forming wall portion 82. However, the present invention is not limited to this example, and one ejection-port forming wall portion 82 may include the first wall portion and the second wall portion.

Furthermore, it is preferable to vary the curvature (R) of the lower edge 821 of the ejection-port forming wall portion 82 in the thickness direction, thereby controlling the adhesive property of a foam body relative to the lower edge 821.

More specifically, the adhesive property becomes stronger with a reduction in the curvature (increase in the radius of curvature) of the lower edge 821 in the thickness direction, as compared with the case where the curvature increases (reduction in the radius of curvature). Thus, if one ejection-port forming wall portion 82 and another ejection-port forming wall portion 82 are set so as to have the same width size of the lower edge 821 in the thickness direction and have different curvatures in the thickness direction, it is possible to make them have different adhesive properties relative to the lower edge 821 of the ejection-port forming wall portion 82. In addition, it may be possible to make them have different adhesive properties, by setting them so as to have different width sizes of the lower edge 821 in the thickness direction as well as different curvatures in the thickness direction.

Furthermore, the wall thickness of the ejection-port forming wall portion 82*h* is configured to be thicker than the wall thickness of the ejection-port forming wall portion 82*f*.

With this configuration, the width size in the thickness direction of the lower edge 821 of the ejection-port forming wall portion 82*h* (first wall portion) is greater than that of the lower edge 821 of the ejection-port forming wall portions 82*f* (second wall portion).

Thus, the adhesive property of a foam body relative to the lower edge 821 of the ejection-port forming wall portion 82*h* is stronger than the adhesive property of the foam body relative to the lower edge 821 of the ejection-port forming wall portions 82*f*.

In other words, of the ejection-port forming wall portion 82*h* and the ejection-port forming wall portions 82*f*, the ejection-port forming wall portion 82*h* serves as the first wall portion, and the ejection-port forming wall portions 82*f* serve as the second wall portion.

Furthermore, the width size of the lower edge 821 of the ejection-port forming wall portion 82*g* and the width size of the lower edge 821 of the ejection-port forming wall portion 82*h* are configured to be equal to each other.

Furthermore, as illustrated in FIGS. 9(*b*) and 9(*c*), the lower edge 821 of the ejection-port forming wall portion 82*h* is formed into an uneven shape, whereas the lower edge 821 of the ejection-port forming wall portion 82*g* is formed into a flat shape. With the lower edge 821 of the ejection-port forming wall portion 82*h* being formed into an uneven shape, the surface area of the lower edge 821 thereof per unit plane area is greater than the surface area of the lower edge 821 of the ejection-port forming wall portion 82*g* per unit plane area. With this configuration, the adhesive property of a foam body (adhesive property resulting from the surface tension) relative to the lower edge 821 of the ejection-port forming wall portion 82*h* is stronger than the adhesive property of the foam body relative to the lower edge 821 of the ejection-port forming wall portion 82*g*.

More specifically, on the lower edge 821 of the ejection-port forming wall portion 82*h*, a recessed portion 85*a* and a protruding portion 85*b* of the uneven shape are alternately formed in the circumferential direction of the ejection-port forming wall portion 82*h*. Still more specifically, the uneven shape of the lower edge 821 of the ejection-port forming wall portion 82*h* is formed into a sawtooth shape such that the protruding portion 85*b* with a crest shape and the recessed portion 85*a* with a trough shape are alternately formed. From the viewpoint of controlling the adhesive property, it is preferable that the difference in height between the protruding portion 85*b* and the recessed portion 85*a* is equal to or more than 0.5 mm, more preferably, equal to or more than 1 mm. In addition, it is preferable that it is equal to or less than 5 mm, more preferably, equal to or less than 3 mm. Furthermore, it is preferable to set it to be equal to or more than 0.5 mm and equal to or less than 5 mm, more preferably, equal to or more than 1 mm and equal to or less than 3 mm.

Furthermore, the uneven shape may be other shape such as emboss.

It may also be considered that the ejection-port forming wall portion 82*h* having the lower edge 821 with the uneven shape serves as the first wall portion, and the ejection-port forming wall portion 82*g* having the lower edge 821 formed into a flat shape serves as the second wall portion.

Thus, the adhesive property of a foam body (adhesive property resulting from the surface tension) relative to the lower edge 821 of the ejection-port forming wall portion 82*h* (first wall portion) is stronger than the adhesive property of the foam body relative to the lower edge 821 of the ejection-port forming wall portion 82*g* (second wall portion).

Furthermore, it may also be considered that the ejection-port forming wall portion 82*h* having the lower edge 821 with a greater width size and also having the lower edge 821 with the uneven shape serves as the first wall portion, and the ejection-port forming wall portion 82*f* having the lower edge 821 with a smaller width size than that of the first wall portion and also having the lower edge 821 formed into a flat shape serves as the second wall portion.

As described above, the ejection-port forming wall portion 82 includes the first wall portion and the second wall portion, and the adhesive property of the foam body relative to the lower edge of the first wall portion is stronger than the adhesive property of the foam body relative to the lower edge of the second wall portion.

In this exemplary embodiment, the adhesive property of a foam body differs between the first wall portion and the second wall portion according to the existence or absence of the uneven shape on the lower edge 821, or the width size of the lower edge 821. However, the present invention is not limited to this example, and it may be possible that the adhesive property of a foam body differs between the first wall portion and the second wall portion according to difference in materials used for the lower edges 821.

In the case of this exemplary embodiment, the foam body is discharged through the foam discharging unit 80, whereby a shaped foam object 93 shaped like the shape of a cross can be formed as illustrated in FIG. 18(*a*).

The shaped foam object 93 includes: a pair of first portions 93*a* each composed mainly by the foam body discharged through the pair of ejection-port forming wall portions 82*f*; a second portion 93*b* composed mainly by the foam body discharged through the ejection-port forming wall portion 82*g*; a third portion 93*c* composed mainly by the foam body discharged through the ejection-port forming wall portion 82*h*; and a fourth portion 93*d* composed mainly by a foam body discharged through the ejection-port forming wall portion 82*i*.

Here, the foam body discharged from the ejection port 83 is flattened between the discharging destination and the ejection port 83 and spreads to a wider area than the ejection port 83 in plan view (expands toward the vicinity of the ejection port 83), and hence, the shape of the foam body is affected by the adhesive property of a foam body relative to the lower edge 821.

More specifically, as illustrated in FIG. 18(*b*), the thickness of the second portion 93*b* is thicker than the thickness of the first portion 93*a* by $\Delta t1$. This is because the width size of the lower edge 821 of the ejection-port forming wall portion 82*g* is greater (in other words, the area of foam body adhered per unit length in the circumferential direction of the ejection-port forming wall portion 82 is greater) than that of the ejection-port forming wall portions 82*f*, and hence, the foam body is pulled upward to be higher by the ejection-port forming wall portion 82*g*.

Furthermore, the thickness of the third portion 93*c* is thicker than that of the second portion 93*b* by $\Delta t2$. This is because, while the lower edge 821 of the ejection-port forming wall portion 82*g* is flat, the lower edge 821 of the ejection-port forming wall portion 82*h* is formed into an uneven shape, and hence, the area of foam adhered per unit plane area of the lower edge 821 of the ejection-port forming wall portion 82*h* is greater, which makes the foam body pulled upward to be higher by the ejection-port forming wall portion 82*h*.

In addition, the ejection-port forming wall portion 82*i* is disposed at the middle point among the ejection-port forming wall portions 82*f*, 82*g*, and 82*h*. Thus, due to the existence of the foam body discharged from the ejection port 83 of the ejection-port forming wall portion 82*i*, discharging is performed from the entire ejection port 83 of each of the ejection-port forming wall portions 82 in a well-balanced manner. That is, since the foam body discharged from the ejection port 83 of each of the ejection-port forming wall portions 82*f*, 82*g*, and 82*h* can be prevented from flowing and moving toward the middle point, it is possible to prevent the shape of the foam body discharged from each of the ejection-port forming wall portions 82*f*, 82*g*, and 82*h* from becoming distorted. As a result, it is possible to easily recognize the difference in height of the foam bodies discharged from the ejection-port forming wall portions 82*f*, 82*g*, and 82*h* (the difference in height of the foam bodies is set on the basis of the difference in adhesive property relative to the lower edge 821 of each of the ejection-port forming wall portions 82*f*, 82*g*, and 82*h* as described above).

Fourth Exemplary Embodiment

Next, a fourth exemplary embodiment will be described with reference to FIG. 10(*a*), FIG. 10(*b*), FIG. 10(*c*), FIG. 19(*a*), and FIG. 19(*b*).

Figure 10A:
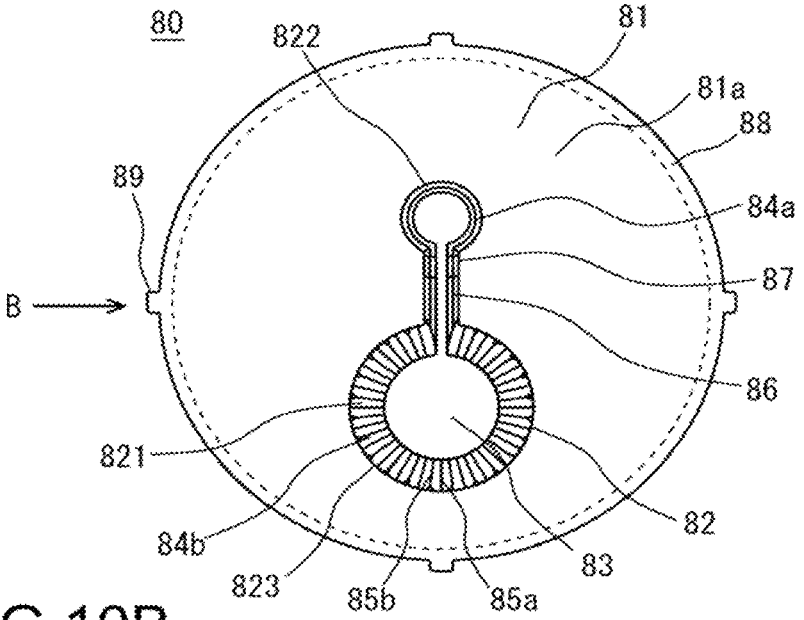
FIGS. 10(*a*), 10(*b*), and 10(*c*) are diagrams each illustrating a foam discharging unit of a foam discharging device according to a fourth exemplary embodiment.
Figure 10B:
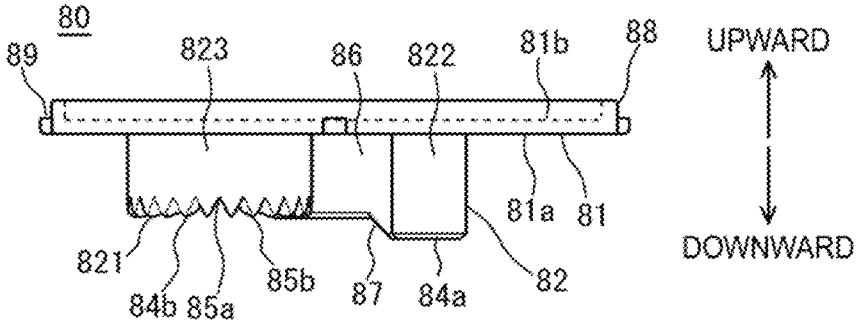
Figure 10C:
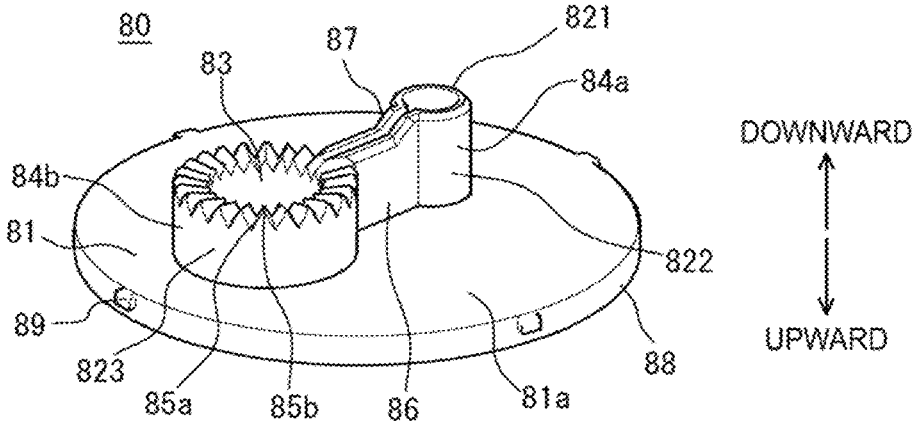
Figure 19B:
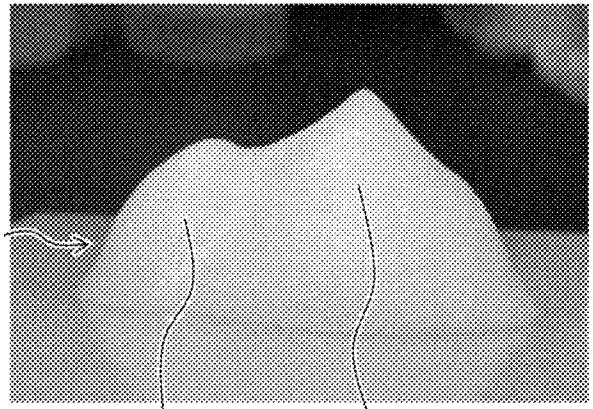
FIGS. 19(*a*) and 19(*b*) are diagrams each illustrating an example of a shaped object of foam.
Figure 19A:
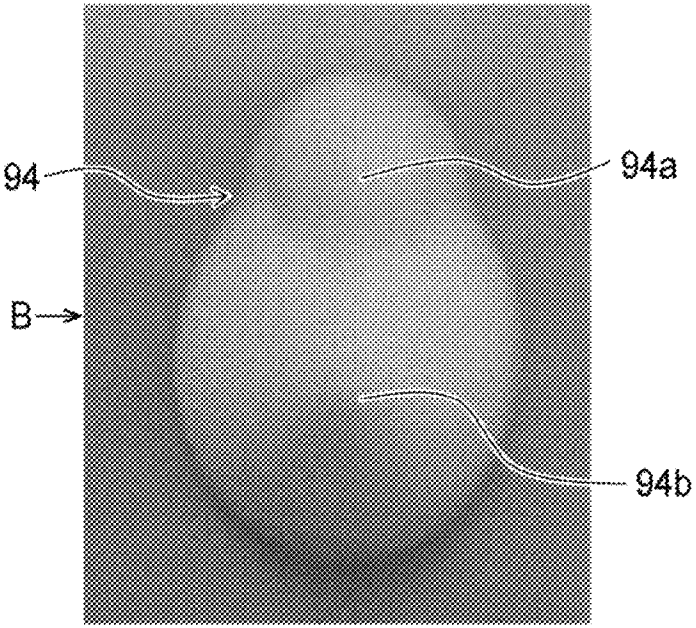

FIG. 19(*a*) is a planer image obtained by imaging a shaped foam object 94 actually formed using the foam discharging unit 80 illustrated in FIGS. 10(*a*) to 10(*c*), and FIG. 19(*b*) is a side image obtained by imaging the shaped foam object 94 from the direction of the arrow B in FIG. 19(*a*) (from the side surface direction).

The foam discharging device 100 and the foam discharging unit 80 according to this exemplary embodiment differ from the foam discharging device 100 and the foam discharging unit 80 according to the first exemplary embodiment described above in terms of the shape of the ejection-port forming wall portion 82, and explanation of the portions common to the foam discharging device 100 and the foam discharging unit 80 according to the first exemplary embodiment described above will not be repeated as appropriate.

In the following description, the positional relationship and the shape of each of the ejection-port forming wall portions 82 of the foam discharging unit 80 may be described on the basis of the positional relationship illustrated in each of the drawings.

As illustrated in FIG. 2, the discharging portion 20 includes the foam passing chamber 209 that allows the foam body to pass, and one or a plurality of ejection-port forming wall portions 82 that: protrude from the foam passing chamber 209; are formed into a closed-loop shape when viewed from the protruding direction; have an inner space communicating with the foam passing chamber 209; and have a tip end having the ejection port 83 formed thereon.

The ejection-port forming wall portion 82 includes a first wall portion (for example, the circular portion 823 illustrated in FIG. 10(*a*)) and a second wall portion (for example, the circular portion 822 illustrated in FIG. 10(*a*)). The adhesive property of a foam body relative to the tip end edge (for example, the lower edge 821) of the first wall portion is stronger than the adhesive property of the foam body relative to the tip end edge (for example, the lower edge 821) of the second wall portion.

In this exemplary embodiment, the adhesive property of a foam body differs between the first wall portion and the second wall portion according to the existence or absence of the uneven shape on the tip end edge, or the width size of the tip end edge. However, the present invention is not limited to this example, and it may be possible that the adhesive property of a foam body differs between the first wall portion and the second wall portion according to difference in materials used for the tip end edge.

In the case of this exemplary embodiment, the protruding direction of the ejection-port forming wall portion 82 from the foam passing chamber 209 is downward, and the downward is a direction from the foam passing chamber 209 toward the ejection port 83. The downward is not limited to the vertically downward, and includes a direction having an angle equal to or less than 5 degrees relative to the vertical direction.

Since the protruding direction of the ejection-port forming wall portion 82 from the foam passing chamber 209 is downward, the tip end edge of the ejection-port forming wall portion 82 is the lower edge 821. In addition, the "ejection-port forming wall portion 82 is formed into a closed-loop shape when viewed from the protruding direction" means that the ejection-port forming wall portion 82 is formed into a closed-loop shape in plan view.

In the case of this exemplary embodiment, the mesh 210 (porous body) is disposed at the outlet of the mixing chamber 208 in which the air and the liquid agent 70 are mixed with each other. The foam body generated in the mixing chamber 208 passes through the mesh 210 and flows into the foam passing chamber 209. After the foam body passes through the foam passing chamber 209, it passes through the inside of the ejection-port forming wall portion 82, and is discharged from the ejection port 83 at the tip end (for example, the lower end) thereof.

Furthermore, the maximum value of the cross sectional area (in this exemplary embodiment, the area of plane cross section), which is perpendicular to the direction of discharge of the foam body, of the foam passing chamber 209 is greater than the maximum value of the cross sectional area (in this exemplary embodiment, the area of plane cross section), which is perpendicular to the direction of discharge described above, of the mixing chamber 208, and is greater than the total value of maximum values of cross sectional areas (in this exemplary embodiment, the area of plane cross section), each of which is perpendicular to the direction of discharge described above, of inner spaces of respective ejection-port forming wall portions 82.

Thus, the maximum value of the cross sectional area described above of the foam passing chamber 209 is greater than the cross sectional area (in this exemplary embodiment, the area of plane cross section), which is perpendicular to the direction of discharged described above, of the outlet of the mixing chamber 208. In addition, the maximum value of the cross sectional area described above of the foam passing chamber 209 is greater than the cross sectional area described above of a portion (in this exemplary embodiment, the bottom end portion of the mixing chamber 208), which is adjacent to the foam passing chamber 209, of the mixing chamber 208. The total value of cross sectional areas, each of which is perpendicular to the direction of discharged described above, of inner spaces of portions (in this exemplary embodiment, the upper end portion of each of the ejection-port forming wall portions 82), each of which is adjacent to the foam passing chamber 209, of each of the ejection-port forming wall portion 82 is smaller than the maximum value of the cross sectional area described above (in this exemplary embodiment, the area of plane cross section) of the foam passing chamber 209. In addition, the total value of cross sectional areas, each of which is perpendicular to the direction of discharge described above, of inner spaces of portions (in the case of this exemplary embodiment, these portions are upper end portions of respective ejection-port forming wall portions 82, and are formed at the bottom portion of the foam passing chamber 209), which are adjacent to the foam passing chamber 209, of the each of the ejection-port forming wall portions 82 is smaller than the area of the bottom portion of the foam passing chamber 209 formed by the plate-like portion 81.

Thus, in the course in which the foam body passes through the mixing chamber 208, the foam passing chamber 209, and the inside of the ejection-port forming wall portion 82 in this order, and is discharged from the ejection port 83, the flow path area for the foam body increases at the position where the foam body flows out from the mixing chamber 208 into the foam passing chamber 209, and then, decreases at the position where the foam body flows out from the foam passing chamber 209 into the ejection-port forming wall portion 82.

With this configuration, it is possible to discharge the foam body from the ejection port 83 at the lower end of the ejection-port forming wall portions 82 while sufficiently filling the inside of each of the ejection-port forming wall portions 82 (in the case of this exemplary embodiment, one ejection-port forming wall portion 82) with the foam body. This makes it possible to discharge the foam body having a desired shape from each of the ejection ports 83 (in the case of this exemplary embodiment, one ejection port 83) in a more reliable manner, and to make a shaped foam object 94 (FIG. 19(*a*), FIG. 19(*b*)), which is a foam body discharged from these ejection ports 83, formed into a desired three-dimensional shape.

The area of plane cross section of the foam passing chamber 209 may be set so as to be constant at any position of the foam passing chamber 209 in the direction of discharge of the foam body, or may be set so as to change according to positions in the direction of discharge of the foam body.

It is preferable that the cross sectional area (in this exemplary embodiment, area of plane cross section), which is perpendicular to the direction of discharge described above, of a portion (the bottom end portion of the foam passing chamber 209), which is adjacent to the ejection-port forming wall portion 82, of the foam passing chamber 209 is greater than the total value of maximum values of cross sectional areas (in this exemplary embodiment, areas of plane cross section), each of which is perpendicular to the direction of discharge described above, of inner spaces of respective ejection-port forming wall portions 82.

Here, the cross sectional area of the inner space of the ejection-port forming wall portions 82 means a cross sectional area of a closed area surrounded in a continuous, circuit manner by an ejection-port forming wall portion 82 in cross section perpendicular to the direction of discharge described above.

In addition, in this exemplary embodiment, the number of the ejection-port forming wall portions 82 is one as illustrated in FIG. 10(*a*), and hence, the total value of cross sectional areas of inner spaces of respective ejection-port forming wall portions 82 means the cross sectional area of the inner space of one ejection-port forming wall 82.

In the case of this exemplary embodiment, the foam discharging unit 80 is a unit for forming a shaped foam object 94 (FIG. 19(*a*), FIG. 19(*b*)) shaped like a snowman, and has one ejection-port forming wall portion 82 as illustrated in FIG. 10(*a*).

As illustrated in FIG. 10(*a*), this ejection-port forming wall portion 82 includes a circular portion 822 for forming the head portion 94*a* (FIG. 19(*a*)) of a snowman, and a circular portion 823 for forming the body portion 94*b* of the snowman. The circular portion 822 is connected with the circular portion 823 through the connecting portion 86 having a slit shape in plan view, and the inner spaces of the two circular portions 822 and 823 communicate with each other through the inner space of the connecting portion 86. The circular portion 823 is formed so as to have a size in plan view larger than that of the circular portion 822.

The ejection-port forming wall portion 82 that forms one ejection port 83 has a non-circular shape in plan view. The ejection-port forming wall portion 82 is comprised of a combination of the circular portion 822 having a smaller size, the circular portion 823 having a larger size, which are portions having shapes in plan view different from each other, and the connecting portion 86. Since the size in plan view differs between the circular portion 822 and the circular portion 823, they are regarded in this specification as having different shapes from each other.

Furthermore, the bottom end portion of part of the ejection-port forming wall portion 82 is formed into a shape of chamfer as illustrated in FIGS. 10(*b*) and (*c*). Thus, the bottom end portion of part of the ejection-port forming wall portion 82 is formed into a shape that has a thickness reduced toward the lower side (the shape of which dimension in the thickness direction becomes narrower toward the lower side).

As illustrated in FIG. 10(*b*), the circular portion 822 is a low-position end portion 84*a* (second portion), and the circular portion 823 is a high-position end portion 84*b* (first portion).

In addition, the transitional portion 87 where the height position of the lower edge 821 changes is formed in the connecting portion 86. In the case of this exemplary embodiment, the transitional portion 87 is configured to be a sloped section in which the height position of the lower edge 821 gradually changes.

More specifically, the width size, in the thickness direction, of the tip end edge of the first wall portion is greater than the tip end edge of the second wall portion. That is, the width size, in the thickness direction, of the lower edge 821 of the circular portion 823 is greater than that of the lower edge 821 of the circular portion 822. With this configuration, the adhesive property of a foam body relative to the lower edge 821 of the circular portion 823 is stronger than the adhesive property of the foam body relative to the lower edge 821 of the circular portion 822.

More specifically, the tip end edge of the first wall portion is formed into an uneven shape, and the tip end edge of the second wall portion is formed into a flat shape. That is, the lower edge 821 of the circular portion 823 is formed into an uneven shape, and the lower edge 821 of the circular portion 822 is formed into a flat shape. This configuration also makes the adhesive property of a foam body relative to the lower edge 821 of the circular portion 823 stronger than the adhesive property of the foam body relative to the lower edge 821 of the circular portion 822.

More specifically, on the tip end edge of the first wall portion, a recessed portion and a protruding portion of the uneven shape are alternately formed in the circumferential direction. That is, on the lower edge 821 of the circular portion 823, the recessed portion 85*a* and the protruding portion 85*b* of the uneven shape are alternately formed in the circumferential direction (the uneven shape having the recessed portion 85*a* and the protruding portion 85*b* alternately in the circumferential direction is formed).

In the case of this exemplary embodiment, one ejection-port forming wall portion 82 includes the circular portion 823 (first wall portion) and the circular portion 822 (second wall portion). In the case of this exemplary embodiment, the lower edge 821 of the connecting portion 86 is formed similarly to the lower edge 821 of the circular portion 822, whereby the adhesive properties are similar to each other, and the connecting portion 86 corresponds to the second wall portion.

As described above, in the case of this exemplary embodiment, the ejection-port forming wall portion 82 has wall portions having different adhesive properties of a foam body from each other, and having different shapes in plan view from each other. That is, the ejection-port forming wall portion 82 includes the circular portion 822 having a smaller size (and the connecting portion 86), and the circular portion 823 having a larger size.

As illustrated in FIG. 10(*b*), the height position of the lower edge 821 of the circular portion 823 is higher than the height position of the lower edge 821 of the circular portion 822. The height position of the lower edge 821 of the circular portion 823 may be set to be an average of height positions of lower edges 821 of individual portions of the circular portion 823. Similarly, the height position of the lower edge 821 of the circular portion 822 may be set to be an average of height positions of lower edges 821 of individual portions of the circular portion 822. In addition, the lower edge 821 of the circular portion 823 has a sawtooth, uneven shape such that a protruding portion 85*b* with a crest shape and a recessed portion 85*a* with a trough shape are alternately formed, and in the description here, the height position of the lower edge 821 of the circular portion 823 represents the height position of the protruding portion 85*b*, which is the lowest end.

The lower edge 821 of the circular portion 822 is disposed so as to be horizontal.

Similarly, the lower edge 821 of the circular portion 823 is disposed so as to be horizontal. That is, the height positions of the recessed portions 85*a* of the lower edge 821 of the circular portion 823 are set so as to be equal to each other, and the height positions of the protruding portions 85*b* of the lower edge 821 of the circular portion 823 are set so as to be equal to each other.

Furthermore, the connecting portion 86 includes the transitional portion 87 in which the height position of the lower edge 821 changes. In the case of this exemplary embodiment, the transitional portion 87 is configured as a sloped section in which the height position of the lower edge 821 gradually changes.

As described above, the foam discharging unit 80 is a foam discharging unit 80 attached to a foam discharging device (here, a thing formed by excluding the foam discharging unit 80 from the foam discharging device 100 is called a foam discharging device) that includes the storage portion 10 that stores the liquid agent 70 and the foamer mechanism 21 that changes the liquid agent 70 into foam to generate a foam body, and the foam discharging unit 80 discharges the foam body. The foam discharging unit 80 includes the plate-like portion 81, and also includes one or the plurality of ejection-port forming wall portions 82 that: protrude from one-side surface (lower surface 81*a*) of the plate-like portion 81; are formed into a closed-loop shape when viewed from the protruding direction; have the inner space communicating with a space of the plate-like portion 81 on a side of the other-side surface (upper surface 81*b*) of the plate-like portion 81; and have a tip end having the ejection port 83 formed thereon. In addition, the ejection-port forming wall portion 82 includes the first wall portion (for example, the circular portion 823) and the second wall portion (for example, the circular portion 822), and the adhesive property of a foam body relative to the tip end edge (for example, the lower edge 821) of the first wall portion is stronger than the adhesive property of the foam body relative to the tip end edge (for example, the lower edge 821) of the second wall portion.

As illustrated in FIGS. 19(*a*) and 19(*b*), in the case of this exemplary embodiment, the shaped foam object 94 includes the head portion 94*a*, and the body portion 94*b* connected with the head portion 94*a*. The head portion 94*a* is composed mainly by a foam body discharged from the circular portion 822, and the body portion 94*b* is composed mainly by a foam body discharged from the circular portion 823.

Here, as illustrated in FIG. 19(*b*), the body portion 94*b* is formed so as to have a thickness thicker than the head portion 94*a*.

This is because of the following complex reasons.

First, this is due to a difference in the amount of foam body discharged. The amount of foam body as used here means the amount per unit plane area.

That is, the reason is that, since the diameter of the circular portion 823 is greater than that of the circular portion 822, the amount of foam body discharged from the circular portion 823 is greater.

Next, the reason is that the amount of foam body discharged from the circular portion 823, which is the high-position end portion 84*b*, is greater than the amount of foam body discharged from the circular portion 822, which is the low-position end portion 84*a*. The reason for a difference in the amount of foam body discharged is that the high-position end portion 84*b* is disposed at a position higher than the low-position end portion 84*a*.

Next, the reason is that the amount of foam discharged from the circular portion 823 at a higher height position is greater than the amount of foam discharged from the circular portion 822 at a lower height position, and the height position where the foam body is released from the lower edge 821 differs between the circular portion 822 and the circular portion 823. The amount of foam as used here means the amount per unit plane area, and the reason for the difference in the amount of foam discharged is that the circular portion 823 is disposed at a position higher than the circular portion 822.

Another reason is a difference in the adhesive property of a foam body of the lower edges 821.

More specifically, the reason is that the width size, in the thickness direction, of the lower edge 821 of the circular portion 823 is greater than the width size, in the thickness direction, of the lower edge 821 of the circular portion 822, and hence, the circular portion 823 has the adhesive property of a foam body per unit length in the circumferential direction of the ejection-port forming wall portion 82 stronger than that of the circular portion 822.

In addition, while the lower edge 821 of the circular portion 822 is formed into a flat shape, the uneven shape is formed on the lower edge 821 of the circular portion 823, and hence, the circular portion 823 has the adhesive property of a foam body per unit length in the circumferential direction of the ejection-port forming wall portion 82 stronger than that of the circular portion 822.

The bottom end portion of the ejection-port forming wall portion 82 may be formed into the shape of chamfer as needed. The portion of the ejection-port forming wall portion 82, of which bottom end portion is formed into the shape of chamfer, is formed into a shape that has a thickness reduced toward the lower side (the shape of which dimension in the thickness direction becomes narrower toward the lower side).

The foam is less likely to adhere on the portion of the ejection-port forming wall portion 82, of which bottom end portion has the shape having a thickness reduced toward the lower side. This enables the bottom end portion of this portion to be favorably separated from the shaped foam object 94. Thus, it is possible to separate the ejection-port forming wall portion 82 from the shaped foam object 94 while minimizing damage to the shape of the shaped foam object 94 that has been foamed.

In the case of this exemplary embodiment, for example, the bottom end portions of the circular portion 822 and the connecting portion 86 are configured to have the shape of chamfer, and it is possible to favorably separate these portions from the shaped foam object 94.

The shape of chamfer of the bottom end portion of the ejection-port forming wall portion 82 may be either a round fillet shape or a chamfering shape, and the chamfering shape is shown in FIG. 10(*a*) as an example.

In the case of this exemplary embodiment, the bottom end portion of part (for example, the circular portion 822 and the connecting portion 86) of the ejection-port forming wall portion 82 in the circumferential direction is formed into a shape that has a thickness reduced toward the lower side, as illustrated in any of FIGS. 10(*a*) to 10(*c*), whereby this part exhibits reduced adhesive force of the foam relative to this bottom end portion. However, the present invention is not limited to this example, and it may be possible that, throughout the entire periphery of the ejection port 83 of the ejection-port forming wall portion 82, the bottom end portion of the ejection-port forming wall portion 82 has a shape that has a thickness reduced toward the lower side.

That is, it may be possible to employ a configuration in which the bottom end portion of at least part of the ejection-port forming wall portion 82 is formed into a shape that has a thickness reduced toward the lower side.

Here, in the case where the bottom end portion of the ejection-port forming wall portion 82 is formed into the shape of chamfer, the width size of the lower edge 821 is the width size of the lower surface excluding the chamfer portion (rather than the width size including the chamfer portion).

According to the fourth exemplary embodiment described above, the adhesive property of a foam body relative to the lower edge 821 of the circular portion 823 is stronger than the adhesive property of a foam body relative to the lower edge 821 of the circular portion 822. Thus, it is possible to create a desired height difference for each portion of the shaped foam object 94 made by the discharged foam body. This makes it possible to form a shaped object of foam having a desired three-dimensional shape with a more elaborate design.

Modification Example 1 of Fourth Exemplary Embodiment

Next, a modification example 1 of the fourth exemplary embodiment will be described with reference to FIGS. 11(*a*), 11(*b*), and 11(*c*).

The foam discharging unit 80 according to this modification example differs from the foam discharging unit 80 according to the fourth exemplary embodiment described above in that the width size of the lower edge 821 of the circular portion 823 is the same as the width size of the lower edge 821 of the circular portion 822, and in other points, is configured similarly to the foam discharging unit 80 according to the fourth exemplary embodiment.

In the case of the present modification example, the difference in thickness between the head portion 94*a* and the body portion 94*b* is smaller than that in the case of the fourth exemplary embodiment described with reference to FIG. 10(*a*), FIG. 10(*b*), FIG. 10(*c*), FIG. 19(*a*), and FIG. 19(*b*). The reason for this is that the difference between the adhesive property of a foam body relative to the lower edge 821 of the circular portion 822 and the adhesive property of a foam body relative to the lower edge 821 of the circular portion 823 results from the existence or absence of unevenness, and does not result from the difference in width size of the lower edge 821.

Modification Example 2 of Fourth Exemplary Embodiment

Figure 12A:
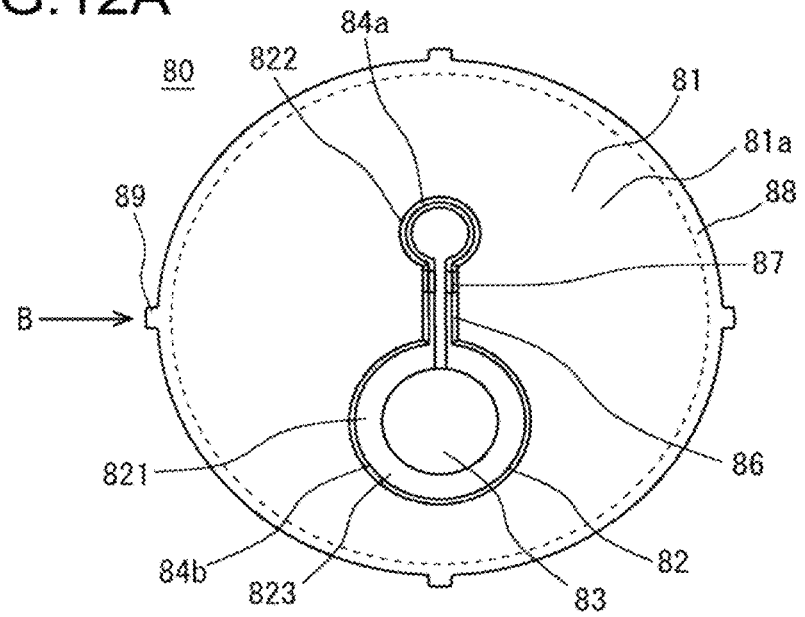
FIGS. 12(*a*), 12(*b*), and 12(*c*) are diagrams each illustrating a foam discharging unit of a foam discharging device according to a modification example 2 of the fourth exemplary embodiment.
Figure 12B:
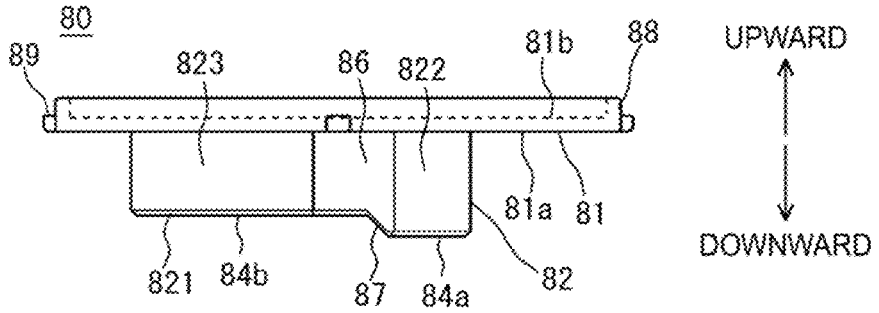
Figure 12C:
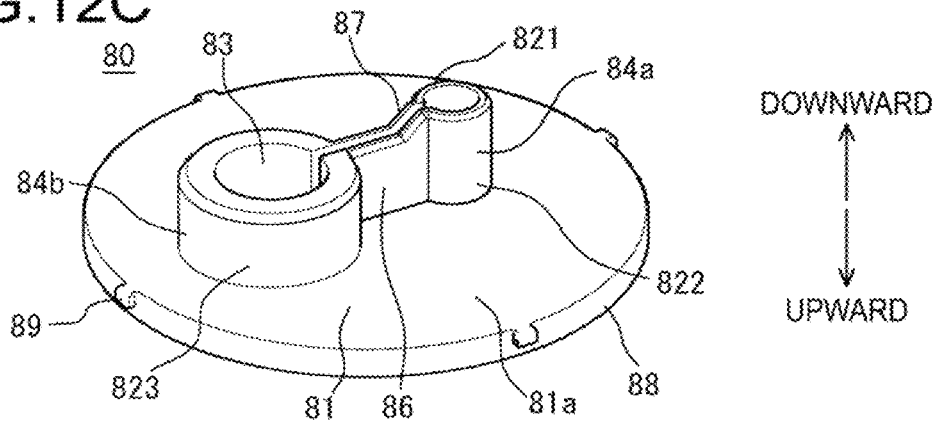

Next, a modification example 2 of the fourth exemplary embodiment will be described with reference to FIGS. 12(*a*), 12(*b*), and 12(*c*).

The foam discharging unit 80 according to this modification example differs from the foam discharging unit 80 according to the fourth exemplary embodiment in that the lower edge 821 of the circular portion 823 is formed into a flat shape, and in other points, is configured similarly to the foam discharging unit 80 according to the fourth exemplary embodiment.

In the case of the present modification example, the difference in thickness between the head portion 94*a* and the body portion 94*b* is smaller than that in the case of the fourth exemplary embodiment described with reference to FIG. 10(*a*), FIG. 10(*b*), FIG. 10(*c*), FIG. 19(*a*), and FIG. 19(*b*). The reason for this is that the difference between the adhesive property of a foam body relative to the lower edge 821 of the circular portion 822 and the adhesive property of a foam body relative to the lower edge 821 of the circular portion 823 results from the difference in width size of the lower edge 821, and does not result from the difference in the existence or absence of unevenness.

Modification Example 3 of Fourth Exemplary Embodiment

Figure 13A:
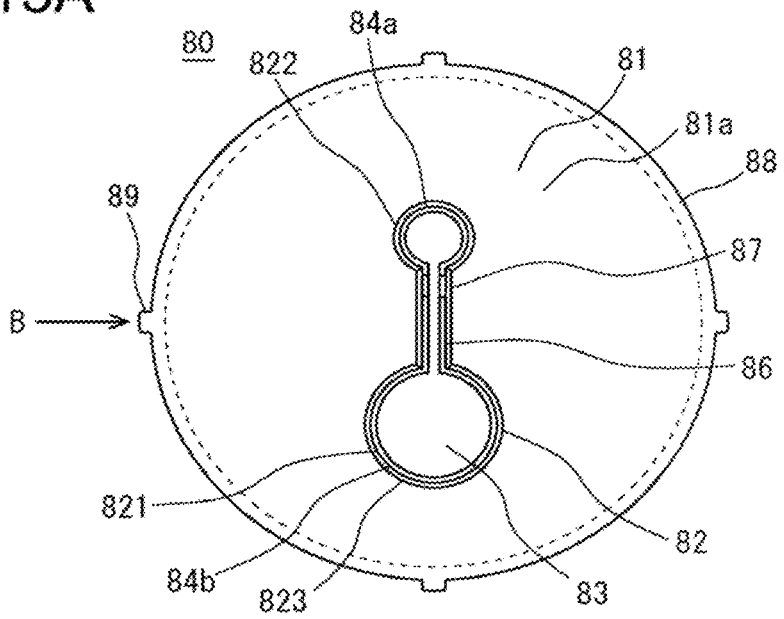
FIGS. 13(*a*), 13(*b*), and 13(*c*) are diagrams each illustrating a foam discharging unit of a foam discharging device according to a modification example 3 of the fourth exemplary embodiment.
Figure 13B:
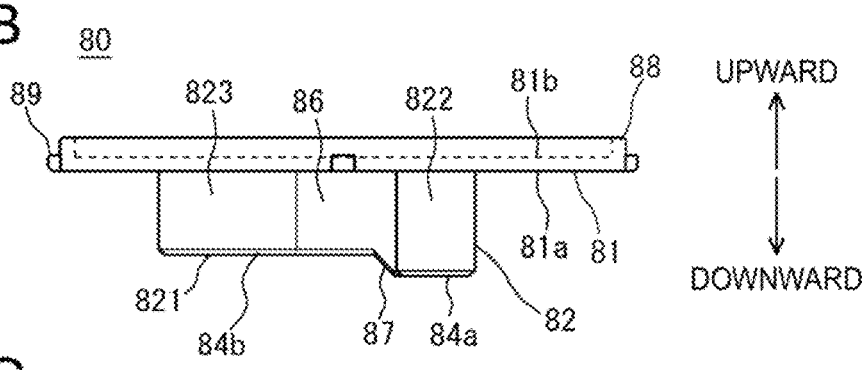
Figure 13C:
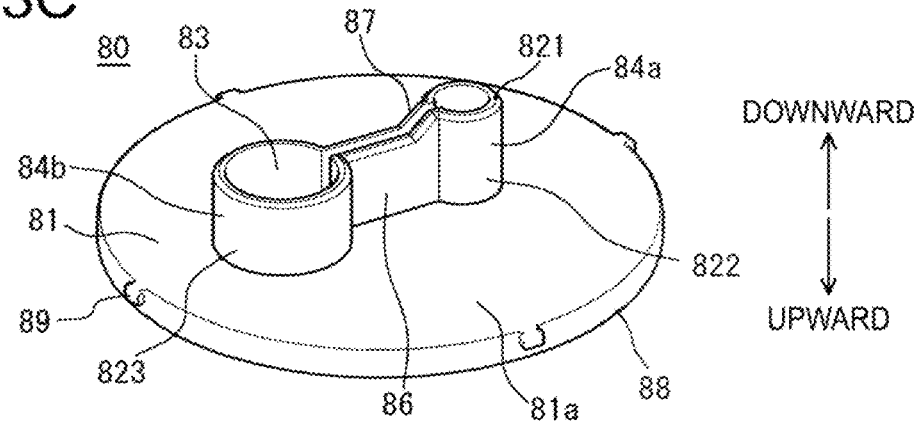

Next, a modification example 3 of the fourth exemplary embodiment will be described with reference to FIGS. 13(*a*), 13(*b*), and 13(*c*).

Figure 11A:
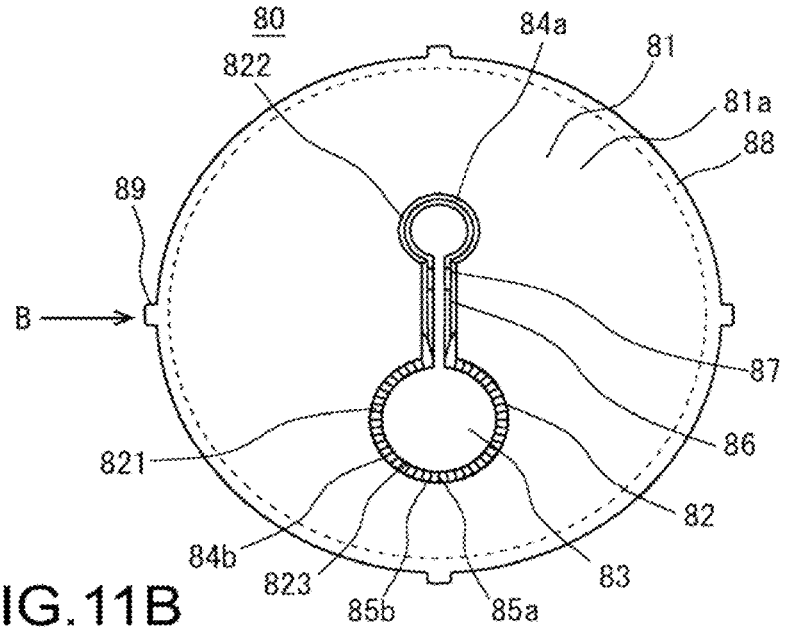
FIGS. 11(*a*), 11(*b*), and 11(*c*) are diagrams each illustrating a foam discharging unit of a foam discharging device according to a modification example 1 of the fourth exemplary embodiment.
Figure 11B:
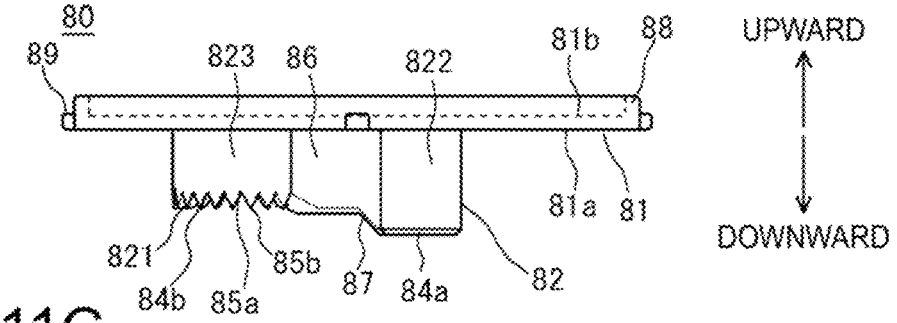
Figure 11C:
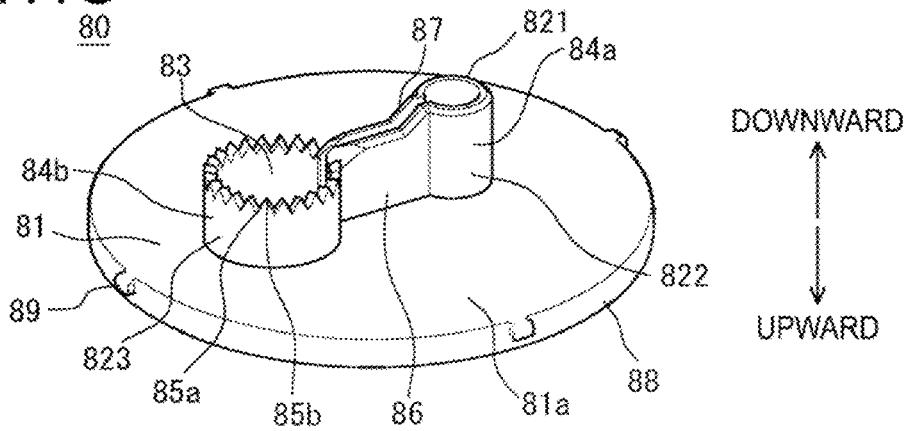

The foam discharging unit 80 according to this modification example differs from that in the modification example 1 illustrated in FIGS. 11(*a*), 11(*b*), and 11(*c*) in that the lower edge 821 of the circular portion 823 is formed into a flat shape, and in other points, is configured similarly to the foam discharging unit 80 according to the modification example 1 illustrated in FIGS. 11(*a*), 11(*b*), and 11(*c*).

In the case of the present modification example, the difference in thickness between the head portion 94*a* and the body portion 94*b* is smaller than that in the case of the modification example 1 illustrated in FIGS. 11(*a*), 11(*b*), and 11(*c*).

<Modification Example of Shape of Bottom End Portion of Ejection-Port Forming Wall Portion>

Figure 14A:
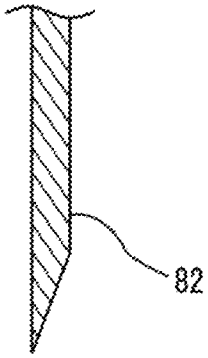
FIGS. 14(*a*), 14(*b*), and 14(*c*) are diagram each illustrating a modification example of the cross-sectional shape of a bottom end portion of an ejection-port forming wall portion.
Figure 14B:
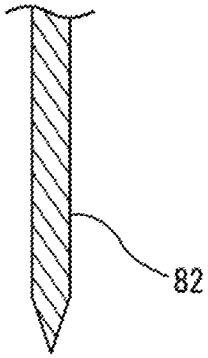
Figure 14C:
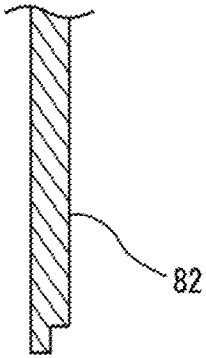

Next, a modification example of the shape of the bottom end portion of the ejection-port forming wall portion 82 will be described with reference to FIGS. 14(*a*), 14(*b*), and 14(*c*). FIGS. 14, 14(*b*), and 14(*c*) each illustrate a cross section obtained by cutting the lower portion of the ejection-port forming wall portion 82 along the thickness direction. The right side area of the ejection-port forming wall portion 82 shown in FIGS. 14, 14(*b*), and 14(*c*) is the inner space (a space inside the closed-loop shape of the ejection-port forming wall portion 82 in plan view) that allows foam to pass through.

As illustrated in FIGS. 14(*a*) and (*b*), the bottom end portion of the ejection-port forming wall portion 82 may be formed into a tapered shape that has a thickness reduced toward the lower side, and may have a tip end having a sharp shape. The bottom end portion of the ejection-port forming wall portion 82 may have a one-side tapered shape (one side of the ejection-port forming wall portion 82 in the thickness direction is tapered) as illustrated in FIG. 14(*a*), or may have both-side tapered shape (both sides of the ejection-port forming wall portion 82 in the thickness direction are tapered) as illustrated in FIG. 14(*b*).

In addition, as illustrated in FIG. 14(*c*), the bottom end portion of the ejection-port forming wall portion 82 may be formed into a stepwise shape such that the one-half portion on one side of the ejection-port forming wall portion 82 in the thickness direction protrudes downward further than the one-half portion on the other side.

By forming the bottom end portion of the ejection-port forming wall portion 82 so as to have the shape as illustrating in FIGS. 14, 14(*b*), and 14(*c*), it is possible to suppress the adhesive property of a foam body (adhesive property relative to the bottom end portion of the ejection-port forming wall portion 82) due to the surface tension, and hence, it is possible to favorably separate the bottom end portion of the ejection-port forming wall portion 82 from the shaped foam object, which makes it easier to form a shaped object of foam having a desired three-dimensional shape with a more elaborate design.

Fifth Exemplary Embodiment

Figure 15:
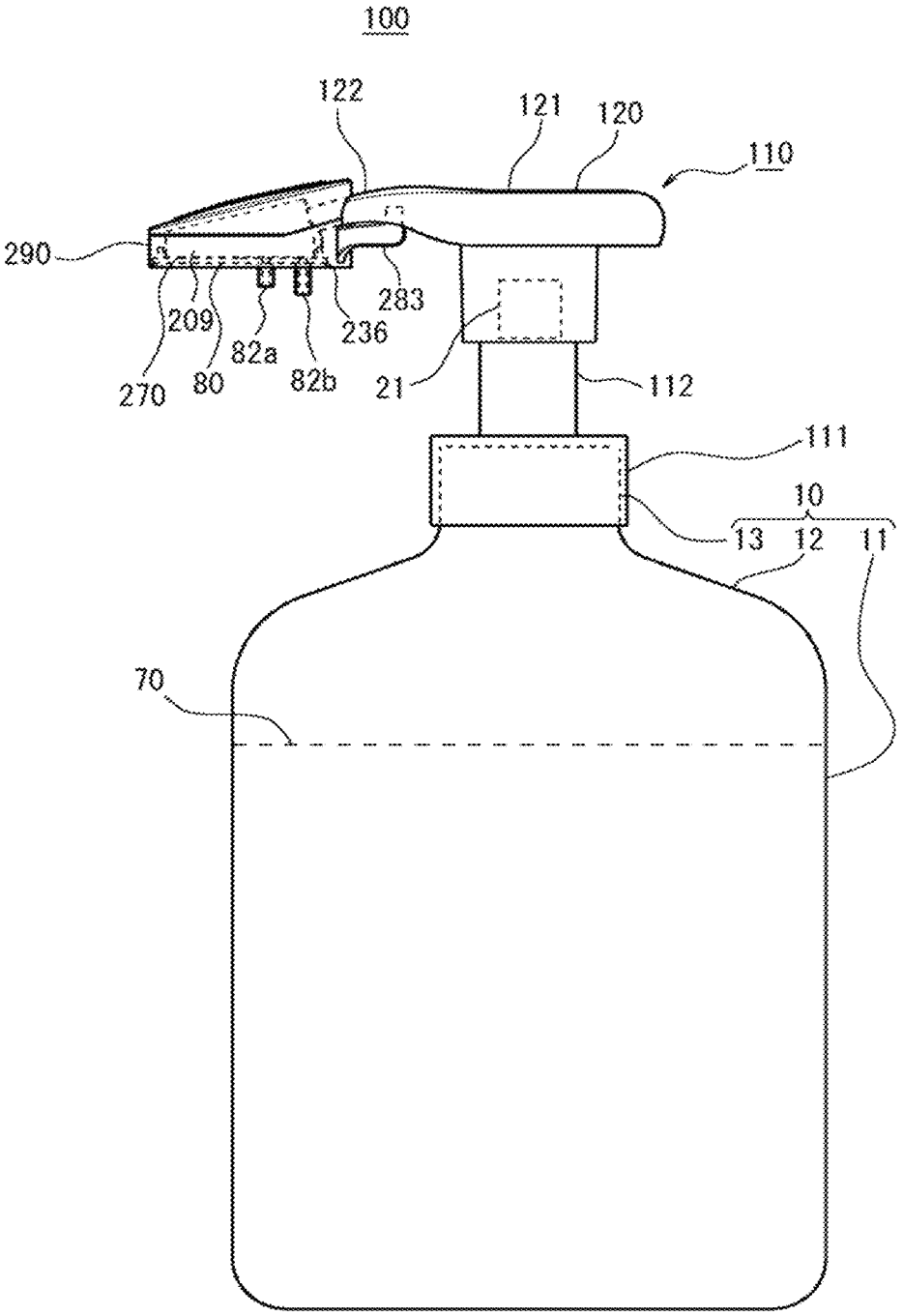
FIG. 15 is a side view illustrating a foam discharging device according to a fifth exemplary embodiment.
Figure 16A:
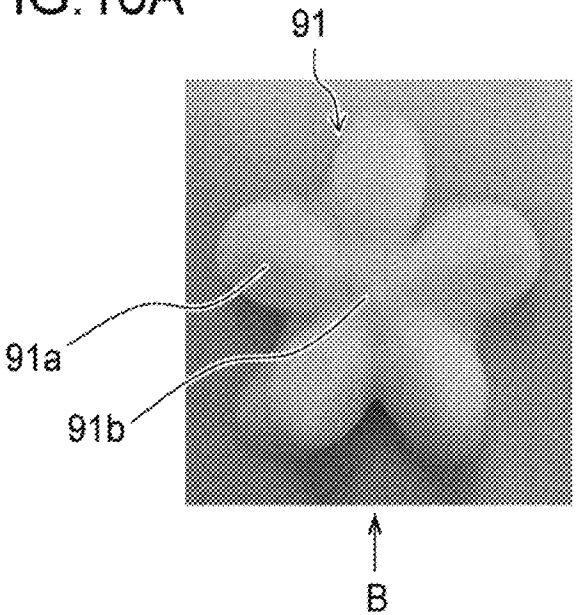
FIGS. 16(*a*), 16(*b*), 16(*c*), and 16(*d*) are diagrams each illustrating an example of a shaped object of foam.
Figure 16B:
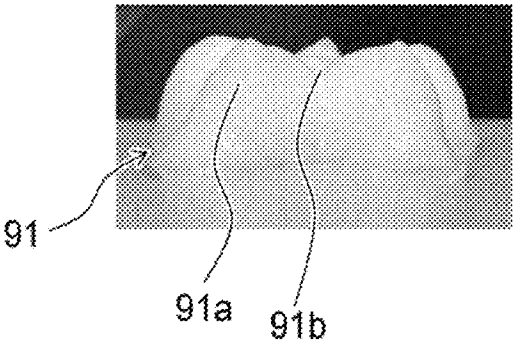
Figure 16C:
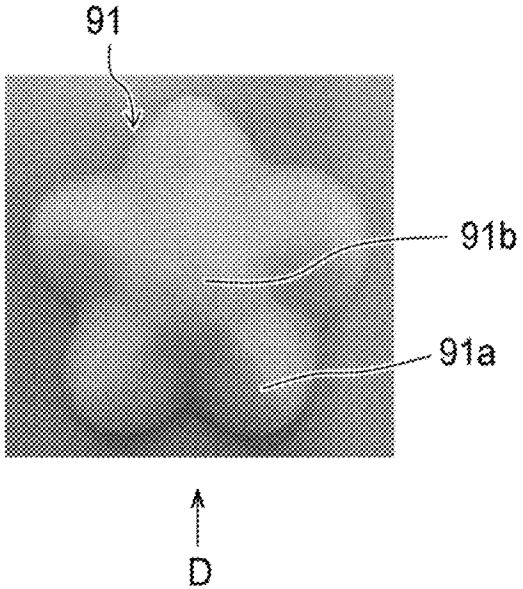
Figure 16D:
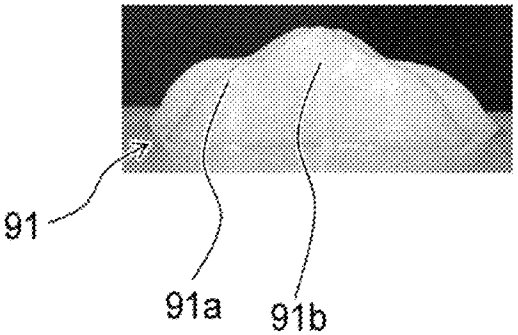
Figure 17A:
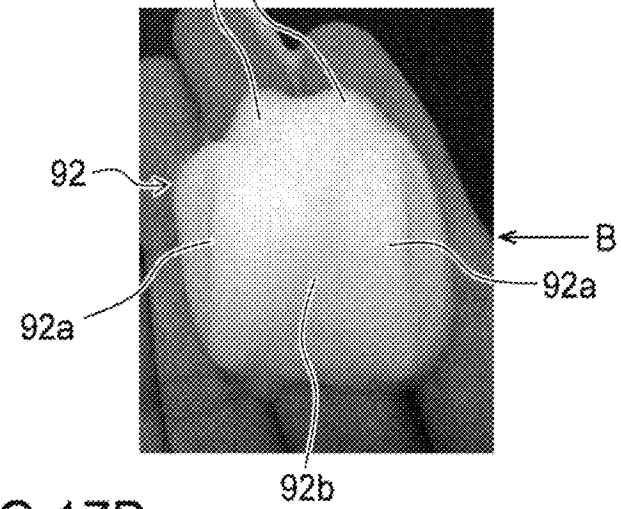
FIGS. 17(*a*), 17(*b*), 17(*c*), and 17(*d*) are diagrams each illustrating an example of a shaped object of foam.
Figure 17B:
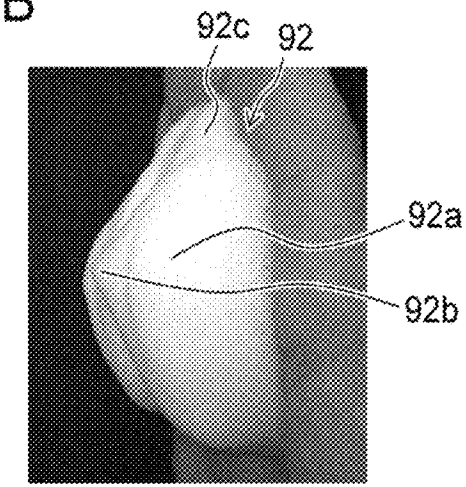
Figure 17C:
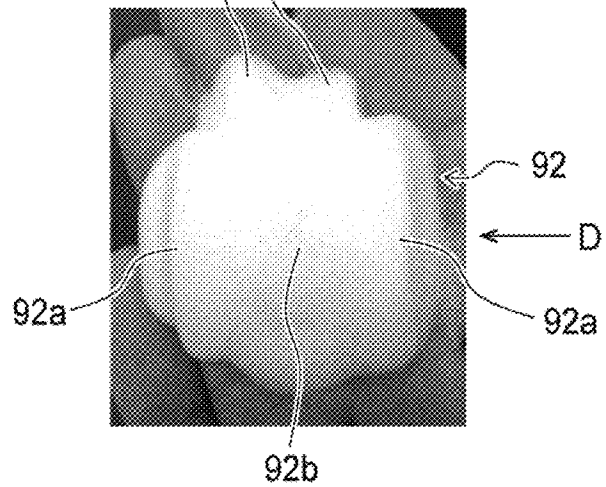
Figure 17D:
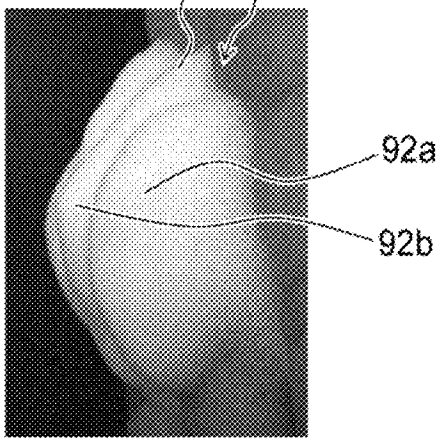

Next, a fifth exemplary embodiment will be described with reference to FIG. 15.

In the first exemplary embodiment described above, description has been made of an example in which the foam discharging device 100 is an automatic dispenser. In this exemplary embodiment, description will be made of an example in which the foam discharging device 100 is a manual-type foam discharging container. That is, in the case of this exemplary embodiment, the foam discharging device 100 includes a foam pump mechanism 110 configured to include a foamer mechanism 21, and generate a foam body with a pushing-down operation.

The shape of the storage portion 10 is not specifically limited. However, as illustrated in FIG. 15, the storage portion 10 has a shape that includes: a body portion 11 having a bottomed hollow-cylindrical shape; a shoulder portion 12 that is connected with the upper side of the body portion 11 and has the area of plane cross section of the cavity thereof reduced toward the upper side; and a neck portion 13 that has a hollow cylindrical shape and is connected with the upper side of the shoulder portion 12. An opening is formed on the upper end of the neck portion 13.

The foam pump mechanism 110 includes, for example: a mounting portion 111 that is mounted on the storage portion 10; an erected tube 112 that is erected upward from the mounting portion 111; a head portion 120 that is held by the erected tube 112 so as to be able to move in an up-down direction relative to the mounting portion 111; a holding member (holding portion) 290 that is detachable relative to the head portion 120; and the foam discharging unit 80 that is held by the holding member 290.

The head portion 120 includes a pushing-down portion 121 that receives a pushing-down operation, and a nozzle portion 122 that protrudes (for example, protrudes almost horizontally) from the pushing-down portion 121. The foam pump mechanism 110 contains a spring (not illustrated) that biases the head portion 120 upward. By pushing down the head portion 120 relatively to the mounting portion 111 so as to resist against the bias of the spring, the liquid agent 70 in the storage portion 10 is sucked through the suction pipe (not illustrated), and is discharged from the tip end of the nozzle portion 122. During this course, the liquid agent 70 changes into foam by the foamer mechanism 21 that the foam pump mechanism 110 contains, and hence, the foam body is discharged from the nozzle portion 122. The structure of the foam pump mechanism 110 is well known, and hence, detailed explanation of the structure will be omitted herein.

The foam passing chamber 209 is formed within the holding member 290. As in the first exemplary embodiment, the foam passing chamber 209 has the bottom portion formed by the plate-like portion 81, and the ejection-port forming wall portion 82 is formed on the bottom portion.

The holding member 290 includes a locking hook 283 that is locked relative to the nozzle portion 122. With the locking hook 283 being locked relative to the nozzle portion 122, the holding member 290 is retained in a state of being held by the nozzle portion 122, and the flow path (not illustrated) of the foam body within the nozzle portion 122 and the foam passing chamber 209 within the holding member 290 are configured to be kept in a communicating state.

It is preferable that, with the locking hook 283 being locked relative to the nozzle portion 122, the tip end portion of the nozzle portion 122 is in a state of being inserted into the inside of the holding member 290.

The holding member 290 is shaped such that the lower surface side of the foam passing chamber 209 is opened. However, the foam discharging unit 80 is provided on the lower surface side of the foam passing chamber 209. The locking portion 236 as in the first exemplary embodiment is formed at the lower portion of the holding member 290, and the foam discharging unit 80 is held by the locking portion 236. With this configuration, the opening on the lower surface side of the holding member 290, except for the ejection port 83 of the ejection-port forming wall portion 82 of the foam discharging unit 80, is closed.

In the case of this exemplary embodiment, the foam body discharged from the nozzle portion 122 with the head portion 120 being pushed down flows into the foam passing chamber 209, and is discharged to the outside through the ejection-port forming wall portion 82 of the foam discharging unit 80.

The foam discharging unit 80 may employ, for example, the structures described in any of the exemplary embodiments or the modification examples thereof. Thus, in response to the pushing-down operation to the pushing-down portion 121, the foam body is discharged through the foam discharging unit 80, whereby the foam body is formed into a shaped foam object having a predetermined shape.

In the fifth exemplary embodiment, description has been made of the foam discharging device 100 of the type in which a foam body is generated through a hand-pressing operation. However, unlike the fifth exemplary embodiment described above, the foam discharging device 100 may be configured such that a liquid agent 70 is discharged as a foam body using, for example, a highly pressurized gas stored, for example, in a cylinder.

The exemplary embodiments described above include the following technical ideas.

<1> A foam discharging device, including:

a storage portion that stores a liquid agent;

a foamer mechanism that changes the liquid agent into foam to generate a foam body; and a discharging portion that discharges the foam body, in which the discharging portion includes:

a foam passing chamber that allows the foam body to pass; and one or a plurality of ejection-port forming wall portions that: extend downward below the foam passing chamber; have a planer shape formed into a closed-loop shape; have an inner space communicating with the foam passing chamber; and have a lower end having an ejection port formed thereon, and (1) a bottom end portion of at least part of the ejection-port forming wall portion is formed into a shape that has a thickness reduced toward the lower side; the ejection-port forming wall portion includes a first portion and a second portion; and the height position of a lower edge of the first portion is higher than the height position of a lower edge of the second portion, or (2) the ejection-port forming wall portion includes a first wall portion and a second wall portion; and an adhesive property of the foam body relative to a lower edge of the first wall portion is stronger than the adhesive property of the foam body relative to a lower edge of the second wall portion.

<2> The foam discharging device according to <1>, in which the foam passing chamber has a bottom portion formed as a plate-like portion, and the ejection-port forming wall portion is formed on the bottom portion.

<3> The foam discharging device according to <1> or <2>, in which the bottom end portion of at least part of the ejection-port forming wall portion is formed into a shape that has a thickness reduced toward a lower side, the ejection-port forming wall portion includes a first portion and a second portion, the height position of a lower edge of the first portion is higher than the height position of a lower edge of the second portion, and one of the ejection-port forming wall portions includes the first portion and the second portion.

<4> The foam discharging device according to <3>, in which the second portion includes a portion that is formed into a flat plate shape that is vertically erected, and a lower edge of this flat-plate shaped portion extends horizontally.

<5> The foam discharging device according to any one of <1> to <4>, in which the bottom end portion of at least part of the ejection-port forming wall portion is formed into a shape that has a thickness reduced toward a lower side, the ejection-port forming wall portion includes a first portion and a second portion, the height position of a lower edge of the first portion is higher than the height position of a lower edge of the second portion, the discharging portion includes a plurality of the ejection-port forming wall portions, and the plurality of ejection-port forming wall portions include a first-portion configuring wall portion that configures the first portion, and a second-portion configuring wall portion that configures the second portion.

<6> The foam discharging device according to any one of <1> to <5>, in which the ejection-port forming wall portion includes a first wall portion and a second wall portion, the adhesive property of the foam body relative to the lower edge of the first wall portion is stronger than the adhesive property of the foam body relative to the lower edge of the second wall portion, and one of the ejection-port forming wall portions includes the first wall portion and the second wall portion.

<7> The foam discharging device according to any one of <1> to <6>, in which the ejection-port forming wall portion includes a first wall portion and a second wall portion, the adhesive property of the foam body relative to the lower edge of the first wall portion is stronger than the adhesive property of the foam body relative to the lower edge of the second wall portion, the discharging portion includes a plurality of the ejection-port forming wall portions, and the plurality of ejection-port forming wall portions include a first-wall-portion configuring wall portion that forms the first wall portion, and a second-wall-portion configuring wall portion that forms the second wall portion.

<8> The foam discharging device according to any one of <1> to <7>, in which (1) the bottom end portion of at least part of the ejection-port forming wall portion is formed into a shape that has a thickness reduced toward the lower side; the ejection-port forming wall portion includes a first portion and a second portion; and the height position of a lower edge of the first portion is higher than the height position of a lower edge of the second portion, and (2) the ejection-port forming wall portion includes a first wall portion and a second wall portion; and the adhesive property of the foam body relative to the lower edge of the first wall portion is stronger than the adhesive property of the foam body relative to the lower edge of the second wall portion.

<9> The foam discharging device according to any one of <1> to <8>, in which the ejection-port forming wall portion includes a first wall portion and a second wall portion, the adhesive property of the foam body relative to the lower edge of the first wall portion is stronger than the adhesive property of the foam body relative to the lower edge of the second wall portion, and a width size, in a thickness direction, of the lower edge of the first wall portion is greater than that of the lower edge of the second wall portion.

<10> The foam discharging device according to any one of <1> to <9>, in which the ejection-port forming wall portion includes a first wall portion and a second wall portion, an adhesive property of the foam body relative to the lower edge of the first wall portion is stronger than the adhesive property of the foam body relative to the lower edge of the second wall portion, and the lower edge of the first wall portion is formed into an uneven shape, and the lower edge of the second wall portion is formed into a flat shape.

<11> The foam discharging device according to <10>, in which the lower edge of the first wall portion is formed such that a recessed portion and a protruding portion of the uneven shape are alternately formed in a circumferential direction.

<12> The foam discharging device according to any one of <1> to <11>, in which the discharging portion includes:

a foam discharging unit including:

a plate-like portion that defines a lower end of the foam passing chamber; and one or a plurality of the ejection-port forming wall portions that extend downward from a lower surface of the plate-like portion; and a holding portion that detachably holds the foam discharging unit.

<13> The foam discharging device according to any one of <1> to <12>, in which the lower edge of the ejection-port forming wall portion has a portion that extends horizontally.

<14> The foam discharging device according to any one of <1> to <13>, further including:

a liquid-agent supplying actuator that supplies the liquid agent from the storage portion to the foamer mechanism;

a gas supplying actuator that supplies gas to the foamer mechanism; and a controller that operates and controls the gas supplying actuator and the liquid-agent supplying actuator, in which the liquid agent and the gas are supplied to the foamer mechanism under the control of the controller to generate the foam body.

<15> The foam discharging device according to any one of <1> to <13>, further including:

a foam pump mechanism configured to include the foamer mechanism to generate the foam body with a pushing-down operation.

<16> The foam discharging device according to any one of <1> to <15>, further including the liquid agent with which the storage portion is filled.

<17> A foam discharging unit that is attached to a foam discharging device including: a storage portion that stores a liquid agent; and a foamer mechanism that changes the liquid agent into foam to generate a foam body, the foam discharging unit discharging the foam body, in which the foam discharging unit includes:

a plate-like portion; and one or a plurality of ejection-port forming wall portions that: protrude from a one-side surface of the plate-like portion in a direction perpendicular to a plate surface of the plate-like portion; are formed into a closed-loop shape when viewed from the protruding direction; have the inner space communicating with a space of the plate-like portion on a side of an other-side surface of the plate-like portion; and have a tip end having an ejection port formed thereon, and (1) a tip end portion of at least part of the ejection-port forming wall portion is formed into a shape that has a thickness reduced toward a tip end; the ejection-port forming wall portion includes a first portion and a second portion; and the distance at the first portion from the plate-like portion to the tip end edge thereof is shorter than the distance at the second portion from the plate-like portion to the tip end edge thereof, or (2) the ejection-port forming wall portion includes a first wall portion and a second wall portion, and an adhesive property of the foam body relative to a tip end edge of the first wall portion is stronger than the adhesive property of the foam body relative to a tip end edge of the second wall portion.

<18> The foam discharging device according to any one of those described above, in which it is preferable that a difference in height between the first portion and the second portion is equal to or more than 1 mm, more preferably, equal to or more than 2 mm, it is preferable that the difference in height is equal to or less than 8 mm, more preferably, equal to or less than 5 mm, and it is preferable that the difference in height is equal to or more than 1 mm and equal to or less than 8 mm, more preferably, equal to or more than 2 mm and equal to or less than 5 mm.

<19> The foam discharging device according to any one of those described above, in which the bottom end portion of the ejection-port forming wall portion is formed into a shape of chamfer.

<20> The foam discharging device according to any one of those described above, in which the bottom end portion of the ejection-port forming wall portion is formed into a tapered shape that has a thickness reduced toward a lower side.

<21> The foam discharging device according to any one of those described above, in which, while a plurality of the ejection-port forming wall portions are each formed into a circular shape in plan view, a group of ejection-port forming wall portions, which is a collective body of the plurality of the ejection-port forming wall portions, forms a non-circular shape as a whole.

<22> The foam discharging device according to any one of those described above, in which a group of ejection-port forming wall portions, which is a collective body of a plurality of the ejection-port forming wall portions, forms a non-circular shape in plan view.

<23> The foam discharging device according to any one of those described above, in which the ejection-port forming wall portion forms a non-circular shape in plan view.

<24> The foam discharging device according to any one of those described above, in which a group of ejection-port forming wall portions, which is a collective body of a plurality of the ejection-port forming wall portions, is comprised of a combination of the plurality of the ejection-port forming wall portions having shapes different from each other in plan view.

<25> The foam discharging device according to any one of those described above, in which the ejection-port forming wall portion is comprised of a combination of a plurality of portions having shapes different from each other in plan view.

<26> The foam discharging device according to any one of those described above, in which in a group of ejection-port forming wall portions, which is a collective body of a plurality of the ejection-port forming wall portions, a low-position end portion is disposed on a peripheral side (outer side), and a high-position end portion is disposed on a central side (inner side).

<27> The foam discharging device according to any one of those described above, in which in the ejection-port forming wall portion, a low-position end portion is disposed on a peripheral side (outer side), and a high-position end portion is disposed on a central side (inner side).

<28> The foam discharging device according to any one of those described above, in which the lower edge of the flat-plate shaped portion is formed into a straight shape.

<29> The foam discharging device according to any one of those described above, in which the foamer mechanism includes a mixing chamber in which the liquid agent and air are mixed with each other, the maximum value of a cross sectional area (area of plane cross section), which is perpendicular to a direction of discharge of the foam body, of the foam passing chamber is greater than the maximum value of a cross sectional area (area of plane cross section), which is perpendicular to the direction of discharge, of the mixing chamber, and also is greater than the total value of maximum values of cross sectional areas (areas of plane cross section), each of which is perpendicular to the direction of discharge, of inner spaces of respective ejection-port forming wall portions.

<30> The foam discharging device according to <29>, in which a cross sectional area (area of plane cross section), which is perpendicular to the direction of discharge, of a portion (the bottom end portion of the foam passing chamber), which is adjacent to the ejection-port forming wall portion, of the foam passing chamber is greater than the total value of maximum values of cross sectional areas (areas of plane cross section), each of which is perpendicular to the direction of discharge, of inner spaces of respective ejection-port forming wall portions.

<A1> A foam discharging device, including:

a storage portion that stores a liquid agent;

a foamer mechanism that changes the liquid agent into foam to generate a foam body; and a discharging portion that discharges the foam body, in which the discharging portion includes:

a foam passing chamber that allows the foam body to pass; and one or a plurality of ejection-port forming wall portions that: extend downward below the foam passing chamber; have a planer shape formed into a closed-loop shape; have an inner space communicating with the foam passing chamber; and have a lower end having an ejection port formed thereon, a bottom end portion of at least part of the ejection-port forming wall portion is formed into a shape that has a thickness reduced toward a lower side, the ejection-port forming wall portion includes a first portion and a second portion, and the height position of a lower edge of the first portion is higher than the height position of a lower edge of the second portion.

<A2> A foam discharging unit that is attached to a foam discharging device including: a storage portion that stores a liquid agent; and a foamer mechanism that changes the liquid agent into foam to generate a foam body, the foam discharging unit discharging the foam body, in which the foam discharging unit includes:

a plate-like portion; and one or a plurality of ejection-port forming wall portions that: protrude from a one-side surface of the plate-like portion in a direction perpendicular to a plate surface of the plate-like portion; are formed into a closed-loop shape when viewed from the protruding direction; have an inner space communicating with a space of the plate-like portion on a side of an other-side surface of the plate-like portion; and have a tip end having an ejection port formed thereon, a tip end portion of at least part of the ejection-port forming wall portion is formed into a shape that has a thickness reduced toward a tip end, the ejection-port forming wall portion includes a first portion and a second portion, and the distance at the first portion from the plate-like portion to the tip end edge thereof is shorter than the distance at the second portion from the plate-like portion to the tip end edge thereof.

<B1> The foam discharging device including:

a storage portion that stores a liquid agent;

a foamer mechanism that changes the liquid agent into foam to generate a foam body; and a discharging portion that discharges the foam body, in which the discharging portion includes:

a foam passing chamber that allows the foam body to pass; and one or a plurality of ejection-port forming wall portions that: protrude from the foam passing chamber; are formed into a closed-loop shape when viewed from the protruding direction; have an inner space communicating with the foam passing chamber; and have a tip end having an ejection port formed thereon, the ejection-port forming wall portion includes a first wall portion and a second wall portion, and an adhesive property of the foam body relative to a tip end edge of the first wall portion is stronger than the adhesive property of the foam body relative to a tip end edge of the second wall portion.

<B2> The foam discharging device according to <B1>, in which a width size, in a thickness direction, of the tip end edge of the first wall portion is greater than that of the tip end edge of the second wall portion.

<B3> The foam discharging device according to <B1> or <B2>, in which the tip end edge of the first wall portion is formed into an uneven shape, and the tip end edge of the second wall portion is formed into a flat shape.

<B4> The foam discharging device according to <B3>, in which the tip end edge of the first wall portion is formed such that a recessed portion and a protruding portion of the uneven shape are alternately formed in a circumferential direction.

<B5> The foam discharging device according to any one of <B1> to <B4>, in which the ejection-port forming wall portion is comprised of a combination of shapes different from each other in plan view.

<B6> The foam discharging device according to <B5>, in which the ejection-port forming wall portion includes wall portions having adhesive properties of the foam body different from each other and having shapes different from each other in plan view.

<B7> A foam discharging unit that is attached to a foam discharging device including: a storage portion that stores a liquid agent; and a foamer mechanism that changes the liquid agent into foam to generate a foam body, the foam discharging unit discharging the foam body, in which the foam discharging unit includes:

a plate-like portion; and one or a plurality of ejection-port forming wall portions that: protrude from a one-side surface of the plate-like portion; are formed into a closed-loop shape when viewed from the protruding direction; have an inner space communicating with a space of the plate-like portion on a side of an other-side surface; and have a tip end having an ejection port formed thereon, the ejection-port forming wall portion includes a first wall portion and a second wall portion, and an adhesive property of the foam body relative to the tip end edge of the first wall portion is stronger than the adhesive property of the foam body relative to the tip end edge of the second wall portion.

EXPLANATION OF REFERENCE CHARACTERS

10 storage portion
20 discharging portion
21 foamer mechanism
30 liquid pump (liquid-agent supplying actuator)
31 suction pipe
32 liquid supplying pipe
40 gas pump (gas supplying actuator)
41 air supplying pipe
50 controller
51 detecting portion
60 body
61 main body portion
62 head portion
70 liquid agent
80 foam discharging unit
81 plate-like portion
81*a* lower surface (one-side surface)
81*b* upper surface (other-side surface)
82, 82*a*, 82*b*, 82*d*, 82*e*, 82*f*, 82*g*, 82*h*, 82*i*, 82*j* ejection-port forming wall portion
821 lower edge
822 circular portion (second wall portion)
823 circular portion (first wall portion)
83 ejection port
84*a* low-position end portion
84*b* high-position end portion
84*c* second low-position end portion
85*a* recessed portion
85*b* protruding portion
86 connecting portion
87 transitional portion
88 annular protrusion
89 locking protrusion
91 shaped foam object
91*a* petal portion
91*b* central portion
92 shaped foam object
92*a* wing portion
92*b* body portion
92*c* antenna portion
93 shaped foam object
93*a* first portion
93*b* second portion
93*c* third portion
94 shaped foam object
94*a* head portion
94*b* body portion
100 foam discharging device
110 foam pump mechanism
111 mounting portion
112 erected tube
120 head portion
121 pushing-down portion
122 nozzle portion
200 discharging unit
201 gas inlet
202 gas front chamber
203 gas passage
205 liquid-agent inlet
206 liquid-agent passage
207 mixing portion
208 mixing chamber
209 foam passing chamber
210 mesh
220 cap member
221 hollow cylindrical portion
222 closing portion
230 hollow cylindrical member
231 external hollow-cylindrical portion
232 internal hollow cylindrical portion
233 closing portion
234 holding portion
235 top surface portion
236 locking portion
237 insertion hole
240 flow-path forming outside sleeve
250 flow-path forming inside sleeve
260 flow-path forming core body
270 mesh
283 locking hook
290 holding member (holding portion)

The invention claimed is:

1. A foam discharging device, including:
a storage portion that stores a liquid agent;
a foamer mechanism that changes the liquid agent into foam to generate a foam body; and
a discharging portion that discharges the foam body, wherein the discharging portion includes:
a foam passing chamber that allows the foam body to pass;
a plate portion; and
an ejection-port forming wall portion that:
extends downward below the foam passing chamber;
has a planar shape formed into a closed-loop shape, the planar shape including two planes extending perpendicularly from the plate portion, the planes being flat, and the planes being substantially parallel to one another;
has an inner space communicating with the foam passing chamber; and
has a lower end having an ejection port formed thereon,
a bottom end portion of at least part of the ejection-port forming wall portion is formed into a shape that has a thickness reduced toward the lower end,
the ejection-port forming wall portion includes a first portion and a second portion,
a height position of a lower edge of the first portion is higher than a height position of a lower edge of the second portion,
the lower edge of the second portion is longer than the thickness of the lower edge of the second portion, and
the height position of the lower edge of the second portion is constant along the entire lower edge of the second portion.

2. The foam discharging device according to claim 1, wherein
the second portion includes a portion that is formed into a flat plate shape that is vertically erected, and
a lower edge of this flat-plate shaped portion extends horizontally.

3. The foam discharging device according to claim 1, wherein
the discharging portion includes a plurality of the ejection-port forming wall portions, and
the plurality of ejection-port forming wall portions include a wall portion that forms the first portion, and a wall portion that forms the second portion.

4. The foam discharging device according to claim 1, wherein the lower edge of the first portion is formed such that a recessed portion and a protruding portion of an uneven shape are alternately formed in a circumferential direction.

5. The foam discharging device according to claim 1, wherein the plate portion defines a lower end of the foam passing chamber, and the discharging portion includes:

a foam discharging unit including:

a plurality of the ejection-port forming wall portions that extend downward from a lower surface of the plate portion; and a holding portion that detachably holds the foam discharging unit.

6. The foam discharging device according to claim 1, further comprising:

a liquid-agent supplying actuator that supplies the liquid agent from the storage portion to the foamer mechanism;

a gas supplying actuator that supplies gas to the foamer mechanism; and a controller that operates and controls the gas supplying actuator and the liquid-agent supplying actuator, wherein the liquid agent and the gas are supplied to the foamer mechanism under the control of the controller to generate the foam body.

7. The foam discharging device according to claim 1, further comprising:

a foam pump mechanism configured to include the foamer mechanism to generate the foam body with a pushing-down operation.

8. The foam discharging device according to claim 1, further comprising the liquid agent with which the storage portion is filled.

9. A foam discharging unit that is attached to a foam discharging device including: a storage portion that stores a liquid agent; and a foamer mechanism that changes the liquid agent into foam to generate a foam body, the foam discharging unit discharging the foam body, wherein the foam discharging unit includes:

a plate portion; and an ejection-port forming wall portion that:

protrudes from a one-side surface of the plate portion in a direction perpendicular to a plate surface of the plate portion; is includes two planes extending in the direction and formed into a closed-loop shape when viewed from the protruding direction, the planes being flat and the planes being substantially parallel to one another;

has an inner space communicating with a space of the plate portion on a side of an other-side surface of the plate portion; and has a tip end having an ejection port formed thereon, a tip end portion of at least part of the ejection-port forming wall portion is formed into a shape that has a thickness reduced toward a tip end, the ejection-port forming wall portion includes a first portion and a second portion, a distance at the first portion from the plate portion to a tip end edge thereof is shorter than a distance at the second portion from the plate portion to a tip end edge thereof, the tip end edge of the second portion is longer than the thickness of the tip end edge of the second portion, and the distance at the second portion from the plate portion to the tip end edge thereof is constant along the entire tip end edge thereof.

10. The foam discharging device according to claim 1, wherein the bottom end portion of the at least part of the ejection-port forming wall portion that is formed into the shape that has the thickness reduced toward the lower end reduces in thickness from an outer wall to an inner wall of the at least part of the ejection-port forming wall portion.

11. The foam discharging device according to claim 1, wherein the foamer mechanism includes a mesh to change the liquid agent into foam to generate the foam body.

12. The foam discharging device according to claim 1, wherein a boundary between the first portion and the second portion is a stepped portion in which the height position of the lower edge changes in a step shape.

* * * * *